US010828695B2

(12) United States Patent
Float et al.

(10) Patent No.: US 10,828,695 B2
(45) Date of Patent: Nov. 10, 2020

(54) SYSTEM AND METHOD FOR MANUFACTURING RAILCAR COUPLER HEADCORES

(71) Applicant: McConway & Torley, LLC, Dallas, TX (US)

(72) Inventors: Joseph T. Float, Manor, PA (US); Joseph L. Gagliardino, Oakdale, PA (US); Scott J. Kramer, Pittsburgh, PA (US); Gerald J. Bricker, Millbury, OH (US); David S. Neuman, Genoa, OH (US)

(73) Assignee: MCCONWAY & TORLEY, LLC, Dallas, TX (US)

( * ) Notice: Subject to any disclaimer, the term of this patent is extended or adjusted under 35 U.S.C. 154(b) by 0 days.

(21) Appl. No.: 15/486,035

(22) Filed: Apr. 12, 2017

(65) Prior Publication Data

US 2017/0297088 A1 Oct. 19, 2017

Related U.S. Application Data

(60) Provisional application No. 62/321,824, filed on Apr. 13, 2016.

(51) Int. Cl.
*B22C 9/10* (2006.01)
*B22C 9/02* (2006.01)
(Continued)

(52) U.S. Cl.
CPC ..... *B22C 9/10* (2013.01); *B22C 9/02* (2013.01); *B22C 9/103* (2013.01); *B22C 9/22* (2013.01); *B22D 25/02* (2013.01); *B61G 3/04* (2013.01)

(58) Field of Classification Search
CPC ..... B22C 9/103; B22C 7/06; B61G 3/04
See application file for complete search history.

(56) References Cited

U.S. PATENT DOCUMENTS 2,830,338 A * 4/1958 Taccone ..... B22C 7/06 164/232
3,888,293 A * 6/1975 Laforet ..... B22C 9/123 164/16

(Continued)

FOREIGN PATENT DOCUMENTS

CN 103328302 A 9/2013
CN 103492102 A 1/2014

(Continued)

OTHER PUBLICATIONS

International Preliminary Report on Patentability for PCT Patent Application No. PCT/US2017/027223, dated Oct. 25, 2018; 8 pages.

(Continued)

*Primary Examiner* — Kevin E Yoon
*Assistant Examiner* — Jacky Yuen
(74) *Attorney, Agent, or Firm* — Baker Botts, LLP

(57) ABSTRACT

A method for manufacturing railcar coupler headcores includes providing a first corebox having internal walls defining at least in part perimeter boundaries of at least one rotor core cavity. The method further comprises at least partially filling the at least one rotor core cavity with a first sand resin to form at least one rotor core. The method also includes providing a second corebox having internal walls defining at least in part perimeter boundaries of at least one headcore cavity. The at least one rotor core is positioned within the second corebox. The method also comprises at least partially filling the at least one headcore cavity with a second sand resin to form at least one headcore.

10 Claims, 18 Drawing Sheets

(51) Int. Cl.

| | |
|---|---|
| ***B22C 9/22*** | (2006.01) |
| ***B22D 25/02*** | (2006.01) |
| ***B61G 3/04*** | (2006.01) |

(56) References Cited

U.S. PATENT DOCUMENTS

| | | | | |
|---|---|---|---|---|
| 8,770,265 | B2 | 7/2014 | Nibouar et al. | |
| 9,868,452 | B2 | 1/2018 | Nibouar et al. | |
| 2007/0125510 | A1 | 6/2007 | Mautino et al. | |
| 2008/0083690 | A1 | 4/2008 | Mautino et al. | |
| 2011/0168655 | A1* | 7/2011 | Nibouar | B61G 3/04 213/100 R |
| 2012/0291980 | A1 | 11/2012 | Nibouar et al. | |
| 2013/0160962 | A1* | 6/2013 | Nibouar | B22C 7/06 164/23 |
| 2016/0151834 | A1* | 6/2016 | Mangoyan | B22D 25/00 164/129 |

FOREIGN PATENT DOCUMENTS

| | | | | |
|---|---|---|---|---|
| DE | 3445732 | A1 * | 6/1986 | B22C 9/103 |
| JP | 59147744 | A * | 8/1984 | B22C 15/24 |

OTHER PUBLICATIONS

PCT Notification of Transmittal of the International Search Report and the Written Opinion of the International Searching Authority, or the Declaration, re Intl. Appln. No. PCT/US2017/027223, dated Jun. 29, 2017.

Office Action for Chinese Patent Application No. 201780023553.0, dated Jan. 21, 2020, no English translation; 11 pages.

Office Action for Chinese Patent Application No. 201780023553.0, dated Aug. 27, 2020, with English summary; 11 pages.

* cited by examiner

400

SYSTEM AND METHOD FOR MANUFACTURING RAILCAR COUPLER HEADCORES

CROSS-REFERENCE TO RELATED APPLICATION

This application claims the benefit of U.S. Provisional Application Ser. No. 62/321,824 filed on Apr. 13, 2016, entitled "System and Method for Manufacturing Railcar Coupler Headcores," which is incorporated herein by reference.

TECHNICAL FIELD

The present disclosure relates generally to railcars, and more particularly to a system and method for manufacturing railcar coupler headcores.

BACKGROUND

Railcar couplers are disposed at each end of a railway car to enable joining one end of such railway car to an adjacently disposed end of another railway car. In general, railcar couplers are manufactured from a cast steel or other alloy using a mold and a core assembly comprising multiple cores. Each core may be used to form one or more internal cavities of a coupler. Conventional methods of manufacturing railcar couplers have included producing couplers using seven to eight cores positioned within a mold. These cores are typically secured in place using nails and/or chaplets. During the casting process itself, the interrelationship of the mold and cores disposed within the mold are critical to producing a satisfactory railcar coupler. If one or more cores move and/or shift out of place during the casting process, the resulting coupler may fail from internal and/or external inconsistencies in the metal walls of the coupler.

SUMMARY

The teachings of the present disclosure relate to a system and method for manufacturing railcar coupler headcores. In accordance with one embodiment, a method for manufacturing railcar coupler headcores includes providing a first corebox having internal walls defining at least in part perimeter boundaries of at least one rotor core cavity. The method further comprises at least partially filling the at least one rotor core cavity with a first sand resin to form at least one rotor core. The method also includes providing a second corebox having internal walls defining at least in part perimeter boundaries of at least one headcore cavity. The at least one rotor core is positioned within the second corebox. The method also comprises at least partially filling the at least one headcore cavity with a second sand resin to form at least one headcore.

Technical advantages of particular embodiments may include providing a headcore that allows a coupler to be manufactured using fewer cores than conventional methods for manufacturing railcar couplers. For example, a single headcore may be used to form the head portion of a coupler (e.g. form multiple cavities and/or internal surfaces of a head portion of a coupler). As a result of using fewer cores (which are subject to moving during casting), an efficient and more stable coupler is manufactured. In particular, by using fewer cores, there is a greater likelihood that the internal cavities and walls of the coupler will be of proper thickness since there are fewer internal cores to move around in the casting process.

Further technical advantages of particular embodiments include horizontally manufacturing coupler headcores using rotor cores vertically positioned within a corebox to reduce the complexity of the geometry and blow-time cycle for manufacturing coupler headcores, which in turn simplifies the headcore manufacturing process and increases the manufacturability of railcar couplers. In addition, the headcores may have more complex parting lines because two parting lines are formed in two separate planes, and are 90 degrees from one another (e.g., the portion of a headcore encompassing a rotor core may have a vertical parting line and the portion of the headcore formed around the rotor core may have a horizontal parting line).

Another advantage of particular embodiments may include a core assembly that includes a headcore and three to four other cores. In such embodiments, fewer materials are required to manufacture a coupler as nails and/or chaplets will not be needed to secure the headcore and other cores in place within a mold. In turn, the time and labor for manufacturing a coupler may be reduced.

Yet another technical advantage of particular embodiments includes a novel headcore design with larger and more precise core prints, which allows for easy mold setting and increases the efficiency of manufacturing coupler headcores, and thus increases the efficiency of manufacturing railcar couplers.

A further technical advantage of particular embodiments includes a headcore with multiple core prints each configured to abut one or more portions of a coupler mold cavity, thereby securing the headcore in place within the coupler mold cavity of a casting box. Accordingly, such core prints prevent the headcore from shifting during the railcar coupler casting process and eliminate the need to secure the headcore in place within the casting box using nails and/or chaplets.

Other technical advantages will be readily apparent to one of ordinary skill in the art from the following figures, descriptions, and claims included herein. Moreover, while specific advantages have been enumerated above, certain embodiments of the present disclosure may include all, some, or none of the enumerated advantages.

BRIEF DESCRIPTION OF THE DRAWINGS

The above and other features and advantages of the present disclosure will become apparent from a consideration of the following detailed description when reviewed in connection with the accompanying drawings, in which.

DETAILED DESCRIPTION

Example embodiments and their advantages are best understood by referring to FIGS. 1 through 12 of the drawings, like numerals being used for like and corresponding parts of the various drawings.

Railcar couplers are disposed at each end of a railway car to enable joining one end of such railway car to an adjacently disposed end of another railway car. In general, railcar couplers are manufactured from a cast steel or other alloy using a mold and a core assembly comprising multiple cores. Each core may be used to form one or more internal cavities of a coupler. Conventional methods of manufacturing railcar couplers have included producing couplers using seven to eight cores positioned within a mold. These cores are typically secured in place using nails and/or chaplets. During the casting process itself, the interrelationship of the mold and cores disposed within the mold are critical to producing a satisfactory railcar coupler. If one or more cores move and/or shift out of place during the casting process, the resulting coupler may fail from internal and/or external inconsistencies in the metal walls of the coupler.

The teachings of this disclosure recognize that it would be desirable to incorporate a rotor core into a process for producing headcores to decrease the number of internal cores used to manufacture railcar couplers, thereby optimizing the production and quality of railcar couplers. In other word, the present disclosure recognizes that it would be advantageous to increase the number of internal surfaces and cavities formed in a railcar coupler with the use of a single headcore. FIGS. 1 through 12 below illustrate a system and method of using a rotor core positioned within a corebox to manufacture a headcore.

Figure 1A:
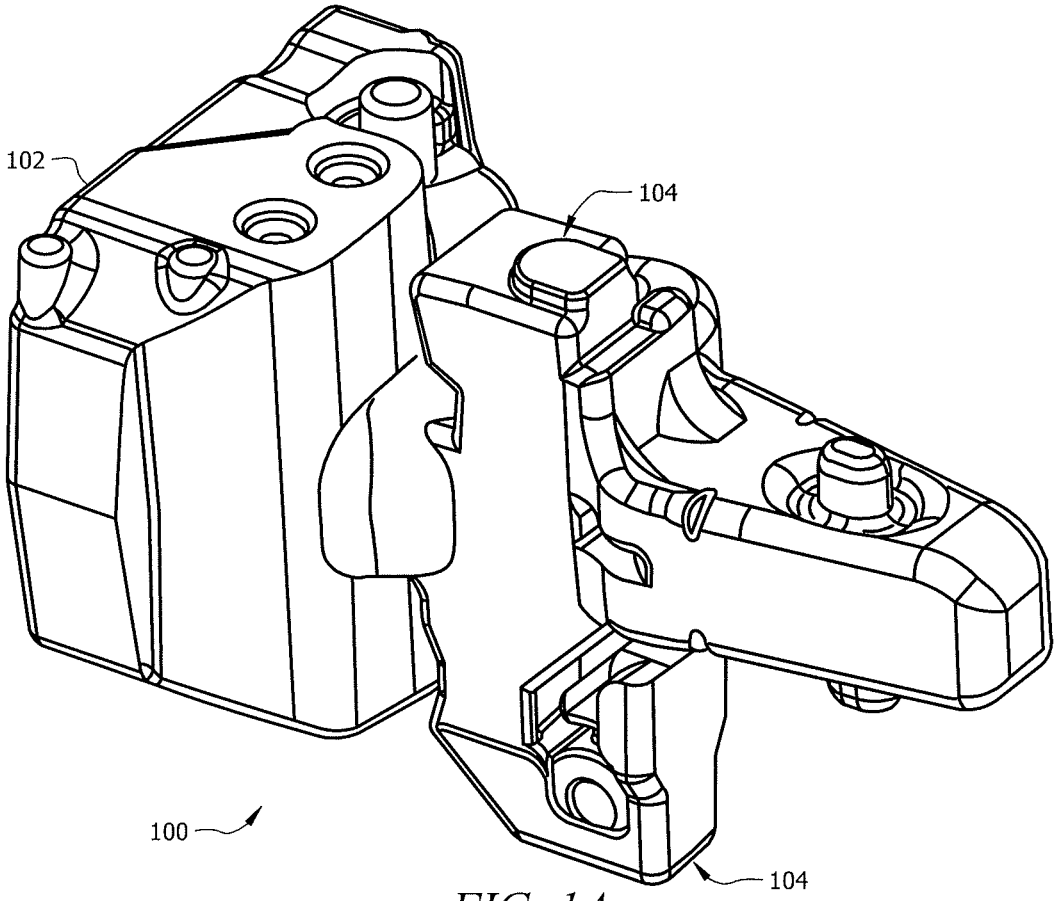
FIGS. 1A through 1C illustrate perspective views of an example headcore of a coupler manufacturing assembly for manufacturing railcar couplers, in accordance with particular embodiments.
Figure 1B:
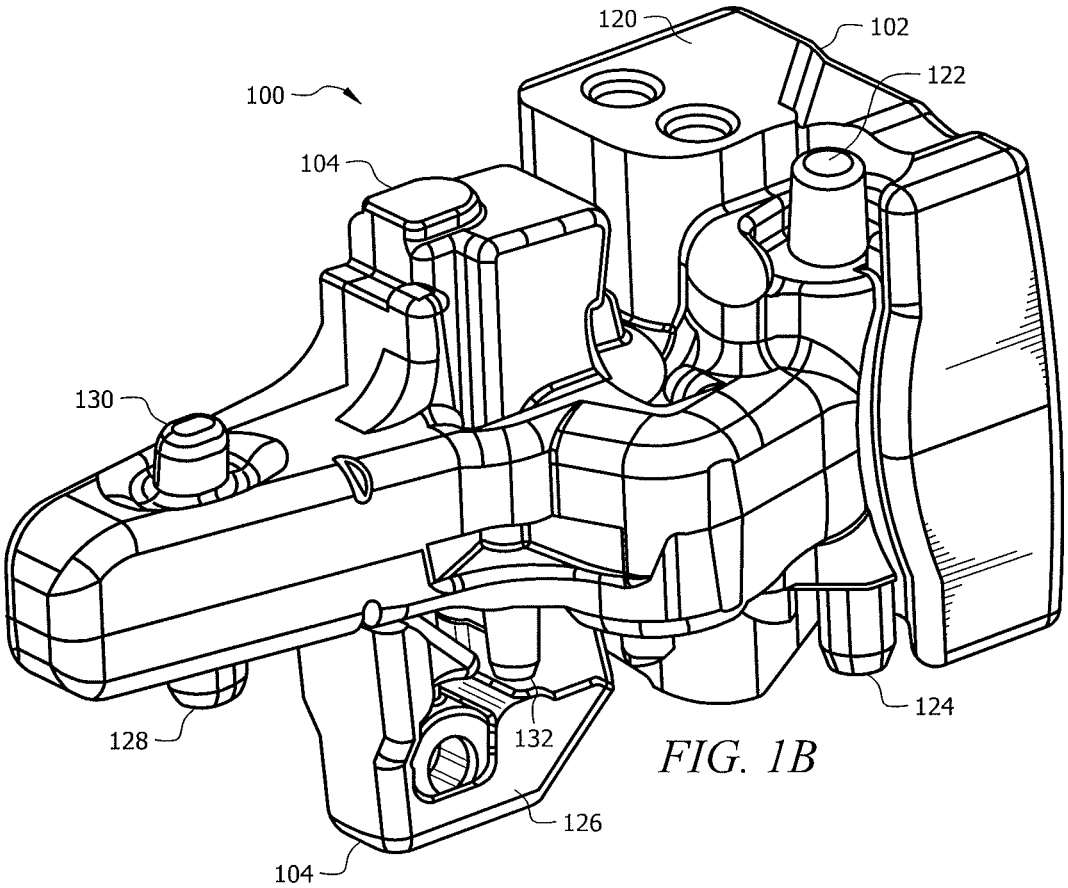
Figure 1C:
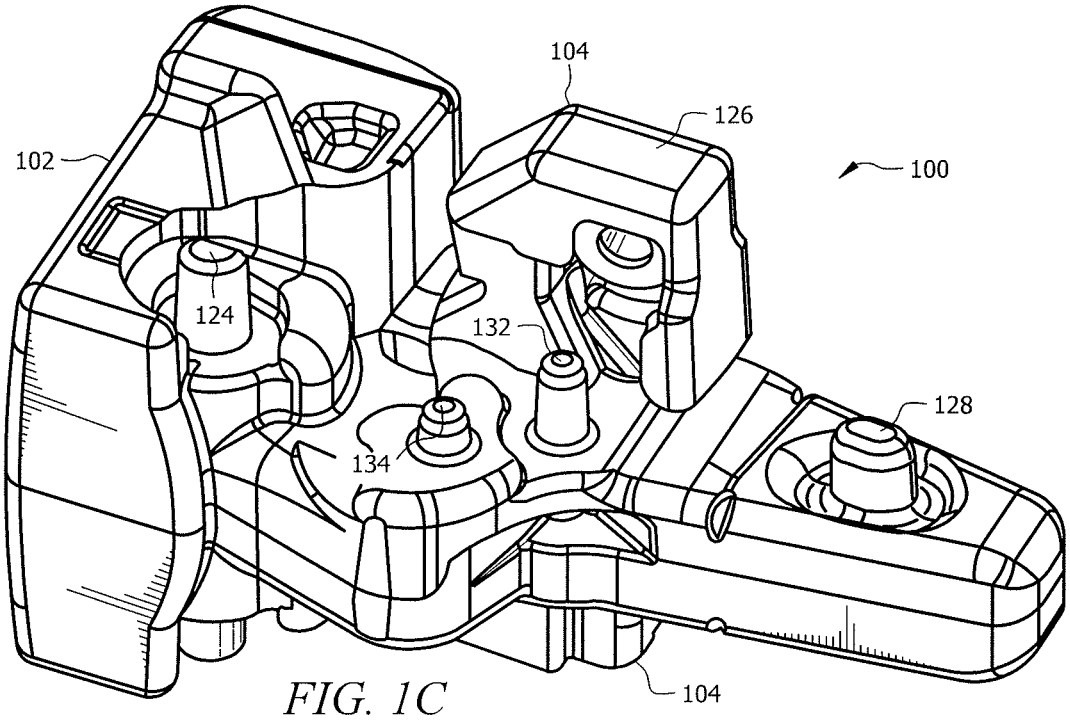

FIGS. 1A through 1C illustrate perspective views of an example headcore of a coupler manufacturing assembly for manufacturing railcar couplers, in accordance with particular embodiments. In general, couplers may be manufactured through a casting process with steel or other alloy. One or more cores may be used in the manufacturing process in order to form various cavities or openings in the coupler. Example cores may be made of resin or otherwise hardened sand. Alternatively, cores may be made from cast iron or steel. As described in more detail below, cores may be produced in a corebox (e.g., a coldbox, hotbox, etc.).

In an example manufacturing process, couplers may be manufactured in a mold cavity within a casting box between cope and drag sections. Sand, such as green sand, is used to define the interior boundary walls of the mold cavity. The mold cavity may be formed using a pattern and may include a gating system for allowing molten alloy to enter the mold cavity. The mold cavities define the exterior surfaces of a coupler. The cores used to form cavities are placed at appropriate locations within the mold cavity. Once the coupler is cast, the sand or resin cores may be removed leaving the cavities. The coupler may undergo a metal finishing process that includes finishing the surfaces of the coupler.

Referring back to FIG. 1A, a coupler manufacturing assembly 100 generally includes a headcore 102. Headcore 102 may be used to form cavities in a coupler casting when molten alloy solidifies around the core. Example headcores 102 may comprise sand resin and/or any other suitable material.

In certain embodiments, each headcore 102 may define the interior of the head portion of a coupler and may include a rotor core 104. For example, as discussed in more detail below with respect to FIGS. 5A through 6C, headcore 102 may be formed by vertically positioning rotor core 104 within a headcore mold cavity of a corebox and then blowing sand into the corebox and around the vertically-positioned rotor core 104. In such an example, the sand unifies around rotor core 104 to form headcore 102. As a result, headcore 102 may be larger than conventional headcores.

In certain embodiments, headcore 102 may have more complex parting lines than a traditional headcore, as the parting lines of headcore 102 may be in two separate planes and 90 degrees from one another (e.g., rotor core 104 encompassed within headcore 102 may have a vertical parting line and the resulting headcore 102 may have a horizontal parting line). Such complex parting lines may reduce the risk of failure during operation. In general, using rotor core 104 to form headcore 102 reduces the total number of internal cores required to manufacture a railcar coupler (e.g., from 7 or 8 cores to 4 or 5 cores).

For example, a conventional coupler manufacturing assembly may include a pin core (e.g., to form the lower portion of a C-10 pinhole cavity (which generally allows access to a C10 pin, during disassembly)), a rotary lock core (e.g., to form the bottom portion of a rotor trunnion), a hose lug core (e.g., to form a brake hose lug (which may be used to support a brake hose)), a lower shelf core (e.g., to form the bottom shelf geometry), a head/shank core (e.g., to form the interior geometry of a coupler head, upper and lower lock chambers, shank, and/or a front face of a coupler), a guard arm core (e.g., to form the cavities of a guard arm of a coupler), and a key slot core (e.g., to form the geometry for a key slot opening of a coupler). However, by using rotor core 104 to form headcore 102 of coupler manufacturing assembly 100, the pin core, hose lug core, and rotary lock core are no longer necessary to manufacture a railcar coupler.

In addition, using rotor core 104 to form headcore 102 increases the total of number of core prints of headcore 102 as compared to conventional headcores, which typically have one core print.

Referring to FIGS. 1B and 1C, a headcore 102 generally comprises a plurality of core prints, such as core prints 120, 122, 124, 126, 128, 130, 132, and 134. Each core print may be configured to abut at least a portion of a coupler mold cavity of a coupler casting box. For example, core prints 120, 122, and 130 may be configured to abut at least an upper portion of a coupler mold cavity to secure headcore 102 to the upper portion of the coupler mold cavity. Similarly, core prints 120, 124, 126, 128, 132, and 134 may be configured to abut at least a bottom portion of a coupler mold cavity to secure headcore 102 to the bottom portion of the coupler mold cavity. Thus, core prints 120, 122, 124, 126, 128, 130, 132, and 134 of headcore 102 prevent headcore 102 from shifting during the railcar coupler casting process and eliminate the need to secure headcore 102 in place within the casting box using nails and/or chaplets. As explained above, headcores 102 generally have more core prints than conventional headcores (e.g., eight as opposed to one).

Although FIGS. 1A through 1C illustrate headcore 102 as having one rotor core 104 and eight core prints 120, 122, 124, 126, 128, 130, 132, and 134, headcore 102 may have any suitable number of rotor cores and core prints. Furthermore, while particular examples of headcore 102 have been described, this disclosure contemplates any suitable headcore 102 configured in any suitable manner.

Figure 2:
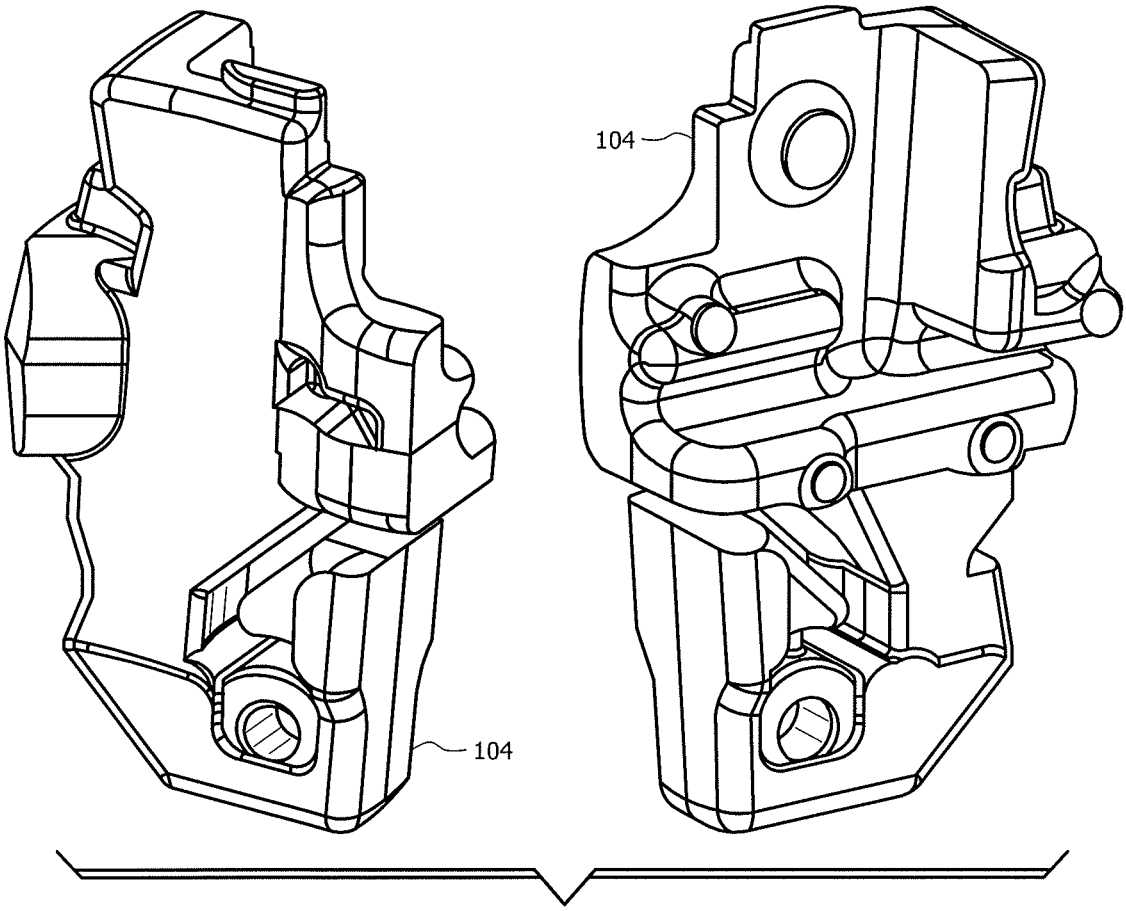
FIG. 2 illustrates a perspective view of an example rotor core for manufacturing coupler headcores, in accordance with particular embodiments.

FIG. 2 illustrates a perspective view of an example rotor core for manufacturing coupler headcores, in accordance with particular embodiments. Rotor core 104 may comprise sand resin or otherwise hardened sand and may be formed in a coldbox machine or any other suitable corebox. In certain embodiments, rotor core 104 may refer to a blown-in sandcore. A blown-in sandcore may be a core that was made by blowing a sand resin and a binder mixture into a corebox using air pressure.

In general, rotor cores 104 facilitate manufacturing headcores 102. Advantages of using rotor cores 104 in the headcore manufacturing process include, but are not limited to, increasing the manufacturability of the complex headcore geometry by allowing for larger and more precise headcore core prints (which produces a tighter tolerance, and reduces the ability of the headcore to shift when the molten steel enters the mold cavity). In addition, the complex headcore geometry involves horizontal and vertical drafted surfaces; introducing rotor cores 104, as blow-in cores, simplifies the complexity by allowing the ability to part the headcore one way. Yet another advantage includes decreasing blow time, which is due to the fact that the presence of rotor cores 104 (blow-in cores) reduces the overall blow sand volume.

Although particular examples of rotor cores 104 have been described with respect to FIG. 2, this disclosure contemplates any suitable rotor cores 104 configured in any suitable manner.

Figure 3A:
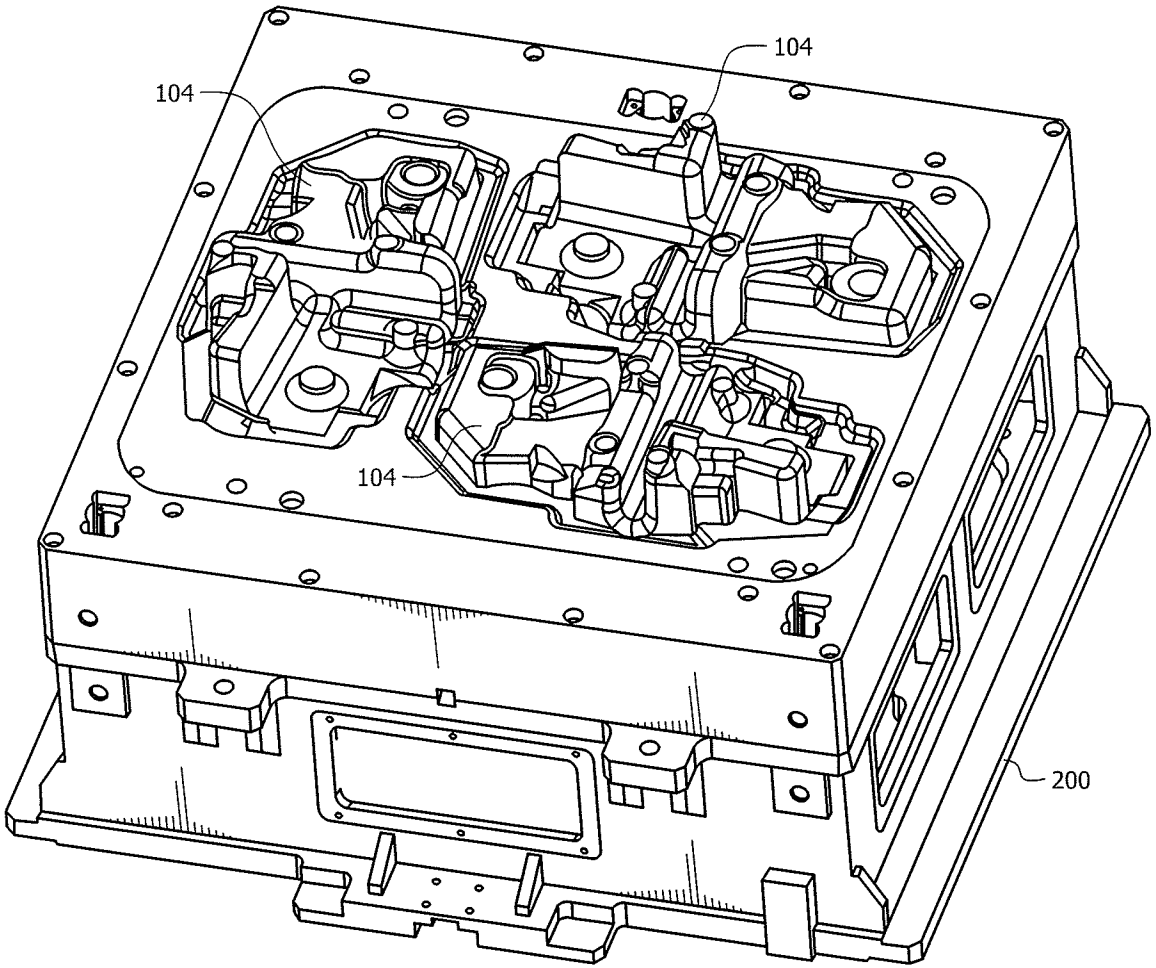
FIGS. 3A and 3B illustrate a perspective view and side view, respectively, of an example corebox for manufacturing rotor cores, in accordance with particular embodiments.
Figure 3B:
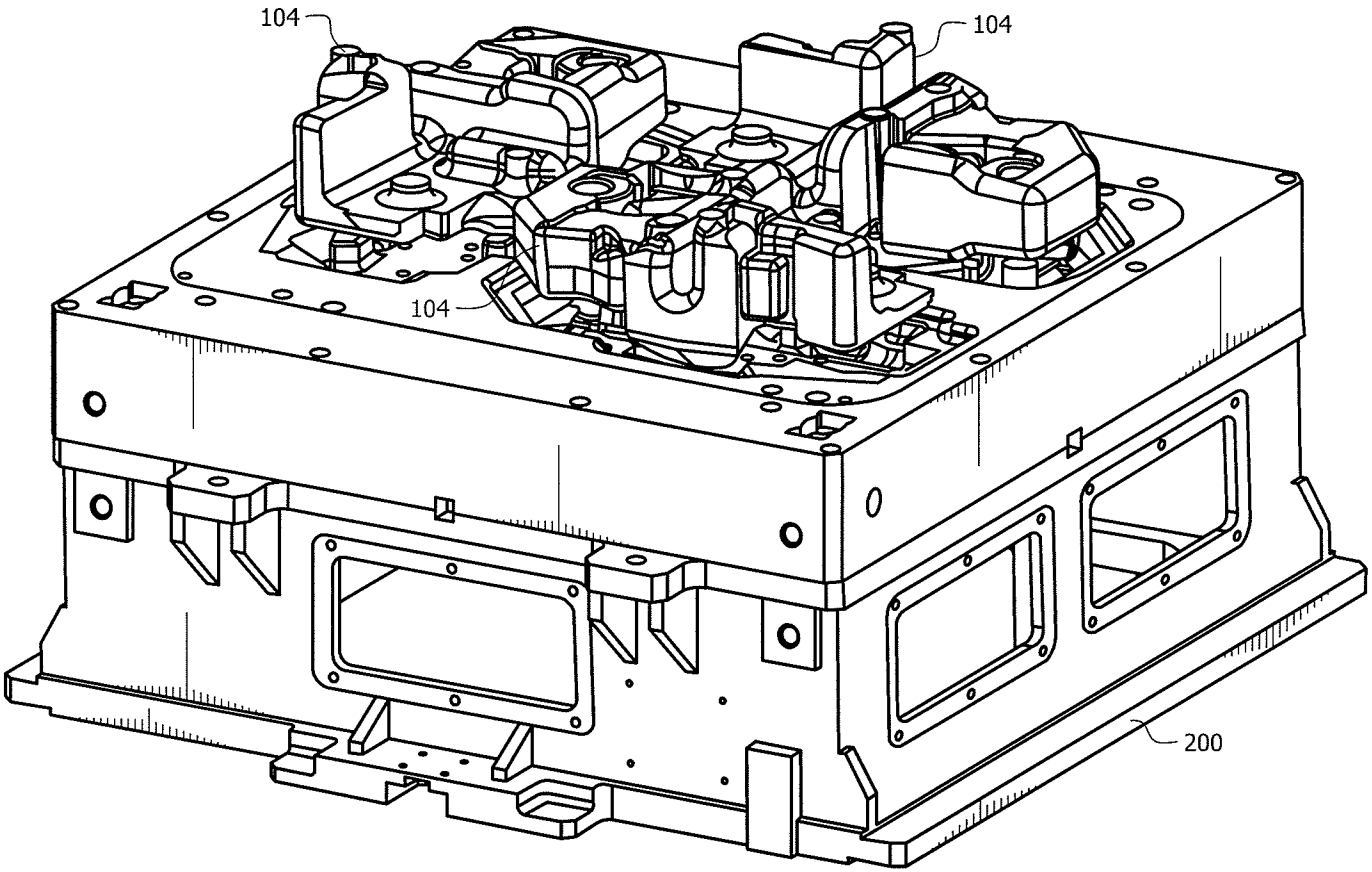

FIGS. 3A and 3B illustrate a perspective view and side view, respectively, of an example corebox for manufacturing rotor cores, in accordance with particular embodiments. A corebox 200 may be configured to manufacture rotor cores 104 and may be made of iron, steel, aluminum, plastic, wood, and/or any other suitable material. Examples of corebox 200 may include a coldbox, hotbox, warmbox, and/or any other suitable corebox.

Corebox 200 may include upper and lower mold portions. Each of upper mold portion (not shown) and lower mold portion may include internal walls defining at least in part perimeter boundaries of rotor core cavities. In an example embodiment, once upper and lower mold portions of corebox 200 are brought together and closed along their parting line, sand may be blown into corebox 200 to form rotor cores 104. After the sand is set, rotor cores 104 may be removed from corebox 200. Using rotor cores 104 to form headcores 102 generally reduces the total number of internal cores required to manufacture railcar couplers (e.g., from 8 cores to 4 or 5 cores). Using rotor cores 104 to form headcores 102 also increases the number of core prints of headcores 102, as explained above with respect to FIG. 1A through 1C.

Although FIGS. 3A through 3B illustrate corebox 200 as manufacturing three rotor cores 104, corebox 200 may manufacture any number of rotor cores 104, such as one rotor core 104, two rotor cores 104, four rotor cores 104, ten rotor cores 104, and so on. Furthermore, while particular examples of the sand casting process, corebox 200, and rotor cores 104 have been described, this disclosure contemplates any suitable sand casting process, corebox 200, and rotor cores 104.

Figure 4:
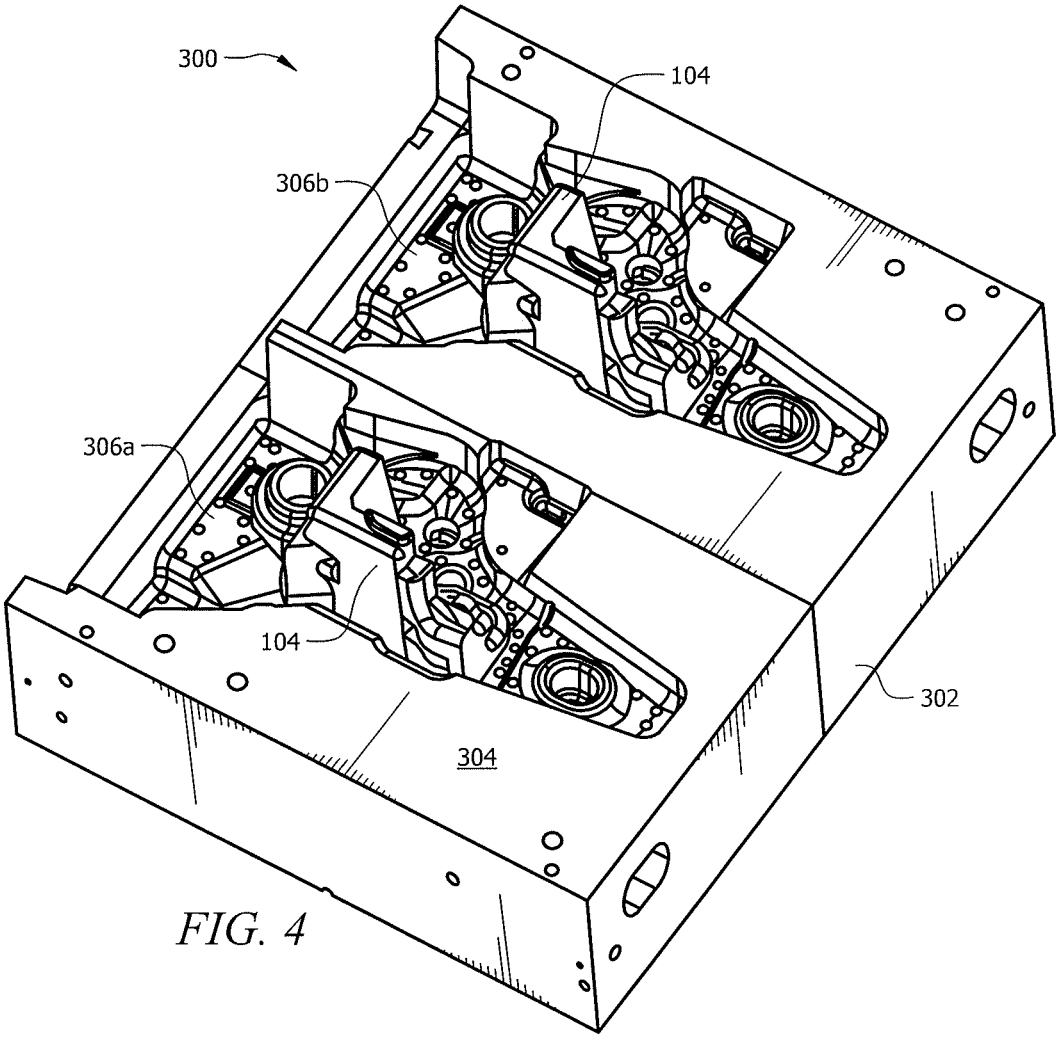
FIG. 4 illustrates example rotor cores positioned within a corebox of a headcore manufacturing assembly for manufacturing coupler headcores, in accordance with particular embodiments.

FIG. 4 illustrates example rotor cores positioned within a corebox of a headcore manufacturing assembly for manufacturing coupler headcores, in accordance with particular embodiments. In general, a headcore manufacturing assembly 300 includes a corebox 302 used to manufacture one or more headcores (such as one or more headcores 102 of FIG. 1). Corebox 302 may be made of iron, steel, aluminum, plastic, wood, and/or any other suitable material. Examples of corebox 302 may include a coldbox, hotbox, warmbox, and/or any other suitable corebox. Corebox 302 may include upper and lower mold portions 304. Each of upper mold portion 304 (not shown) and lower mold portion 304 may include internal walls defining at least in part perimeter boundaries of headcore cavities, such as headcore cavities 306.

In an example embodiment, at least two rotor cores 104 may be placed in an appropriate location within lower mold portion 304 of corebox 302. For example, a rotor core 104 may be positioned vertically within a lower portion of a headcore cavity 306*a* of lower mold portion 304 and another rotor core 104 may be positioned vertically within a lower portion of a headcore cavity 306*b* of lower mold portion 304. In certain embodiments, each rotor core 104 may be secured to a portion of a respective headcore cavity 306.

Once rotor cores 104 have been placed within lower mold portion 304, upper mold portion 304 may be aligned with and coupled to lower mold portion 304 to close corebox 302 and form headcore cavities 306.

Although particular examples of rotor cores 104, corebox 302, upper and lower mold portions 304, and headcore cavities 306 have been described with respect to FIG. 4, this disclosure contemplates any suitable rotor cores 104, corebox 302, upper and lower mold portions 304, and headcore cavities 306, configured in any suitable manner. Furthermore, while particular examples of positioning rotor cores 104 have been described, the present disclosure contemplates any suitable placement of rotor cores 104 in any suitable order and in any suitable direction.

Figure 5A:
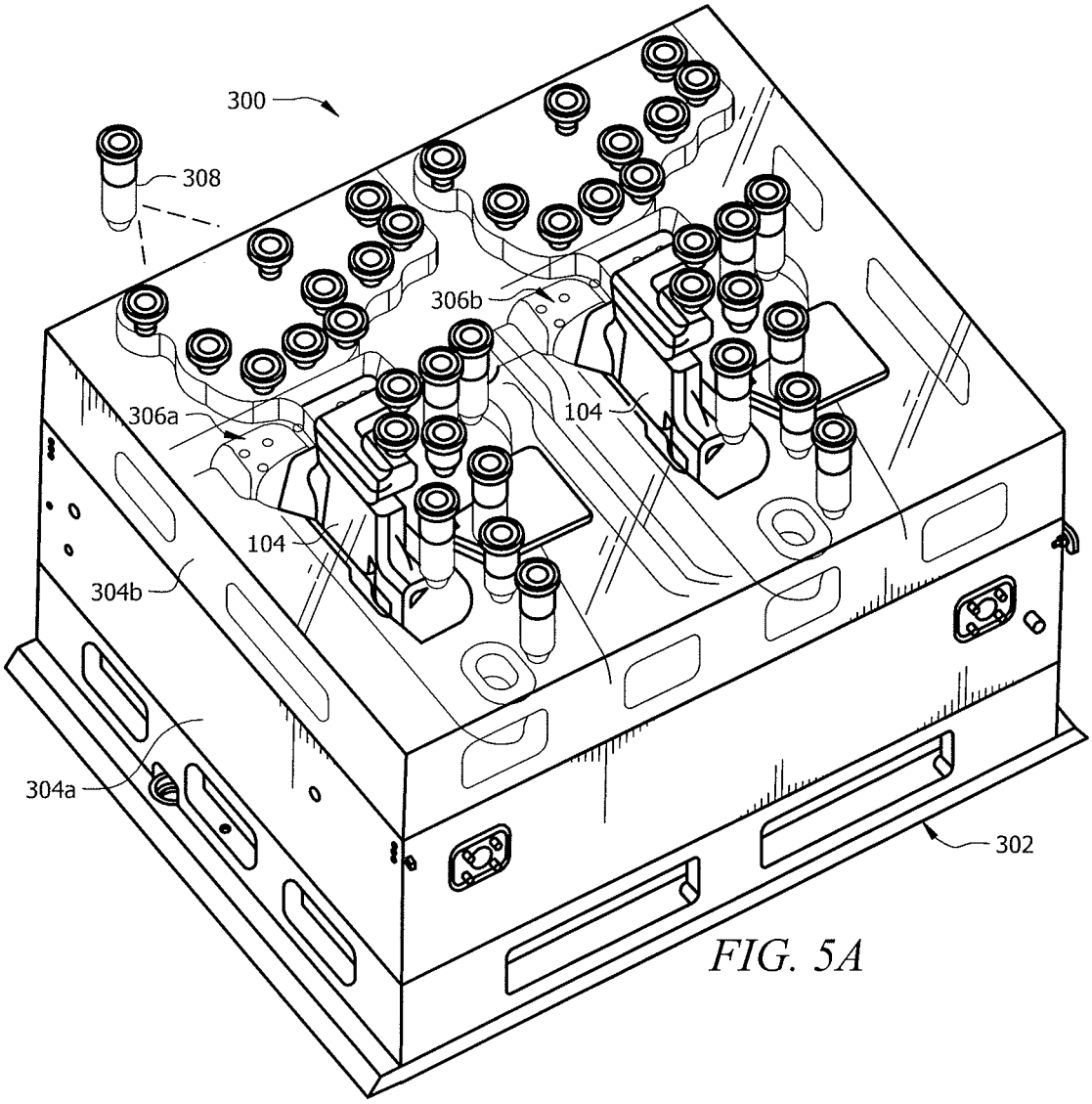
FIGS. 5A through 5C illustrate an example headcore manufacturing assembly for manufacturing coupler headcores, in accordance with particular embodiments.
Figure 5B:
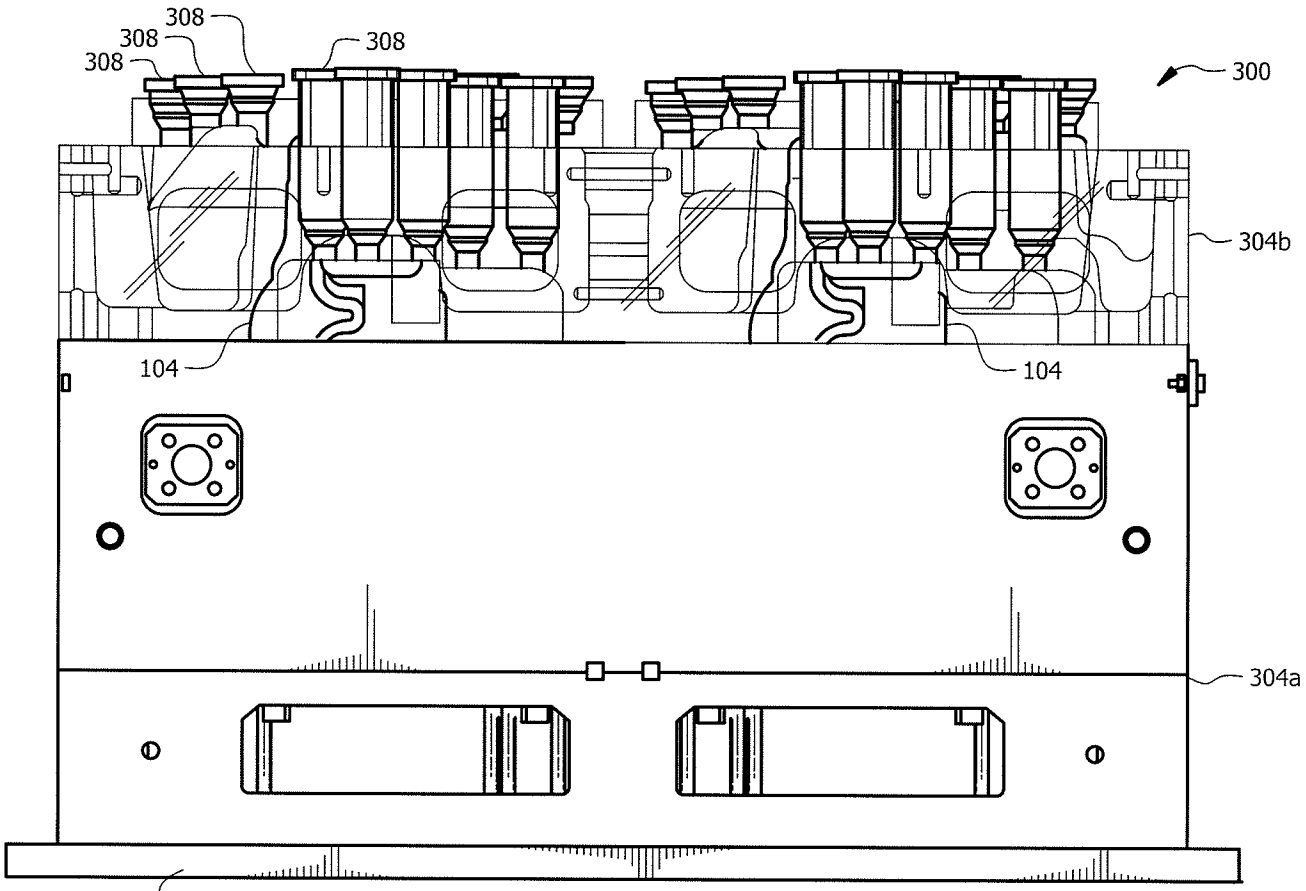
Figure 5C:
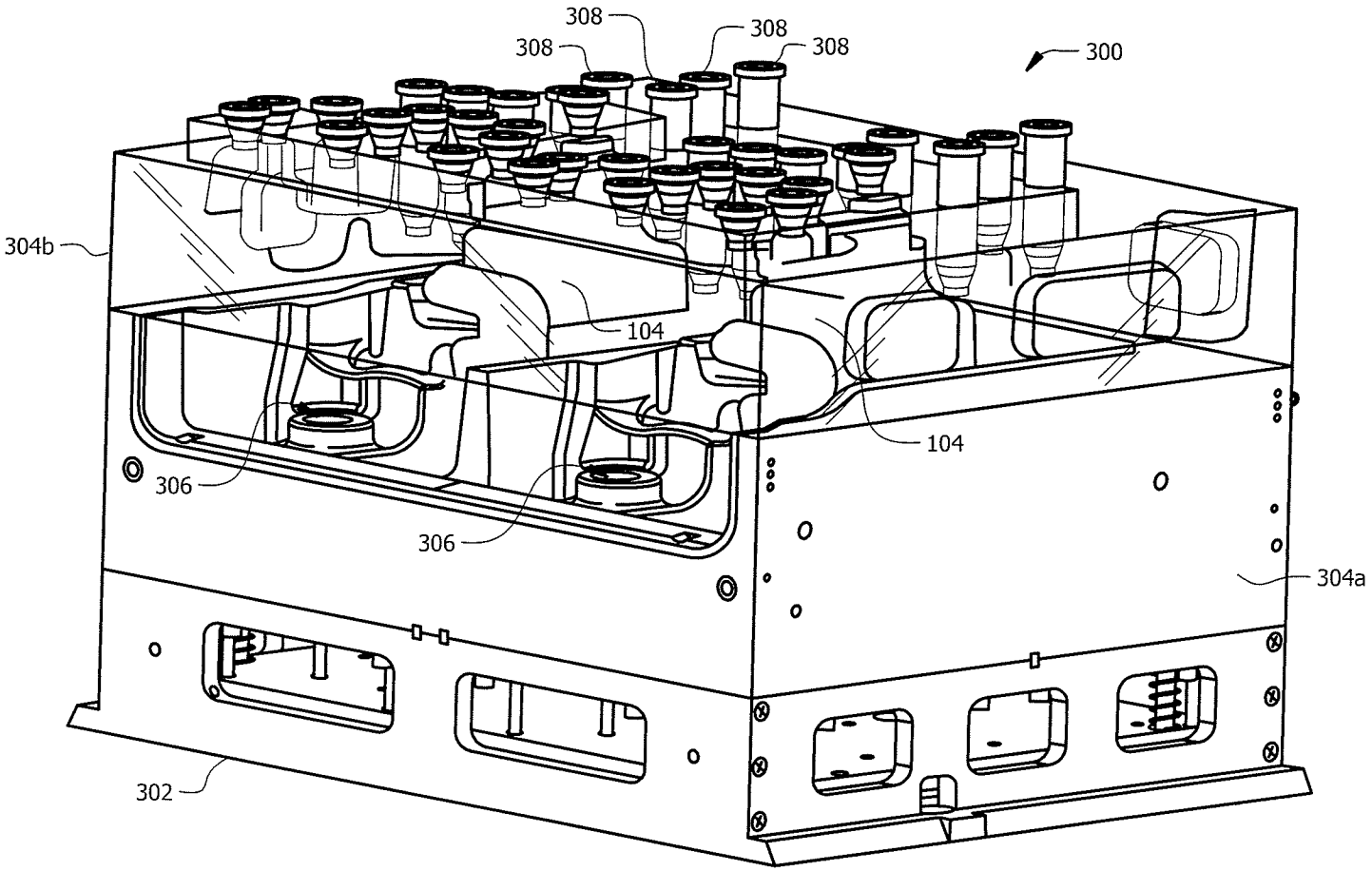

FIGS. 5A through 5C illustrate an example headcore manufacturing assembly for manufacturing coupler headcores, in accordance with particular embodiments. Headcore manufacturing assembly 300 may include a corebox 302 and blow tubes 308. Corebox 302 may be made of iron, steel, aluminum, plastic, wood, and/or any other suitable material. Examples of corebox 302 may include a coldbox, hotbox, warmbox, and/or any other suitable corebox. According to the illustrated embodiment, corebox 302 may include lower and upper mold portions 304 (such as lower mold portion 304*a* and upper mold portion 304*b*). Each of lower mold portion 304*a* and upper mold portion 304*b* may include internal walls defining at least in part perimeter boundaries of headcore cavities 306 (such as headcore cavities 306*a* and 306*b*).

Sand and/or any other suitable material may be blown into headcore cavities 306 of corebox 302 via blow tubes 308. Example blow tubes 308 may be made from steel and/or rubber (e.g., steel with rubber tips). Each blow tube 308 may be mechanically inserted into upper mold portion 304*b* (e.g., all at once or in series), and may extend from a top surface of upper mold portion 304*b* to a bottom surface of upper mold portion 304*b*. In general, blow tubes 308 allow sand to pass through upper mold portion 304*b* and into headcore cavities 306. In certain embodiments, nineteen blow tubes 308 may be used to fill each headcore cavity 306 with sand. Alternatively, any suitable number of blow tubes 308 may be used to fill each headcore cavity 306 with sand.

In an example embodiment, at least two rotor cores 104 may be placed in an appropriate location within lower mold portion 304*a* of corebox 302. For example, a rotor core 104 may be positioned vertically within a lower portion of a headcore cavity 306*a* of lower mold portion 304*a* and another rotor core 104 may be positioned vertically within a lower portion of a headcore cavity 306*b* of lower mold portion 304*a*. Once rotor cores 104 have been placed within lower mold portion 304*a*, upper mold portion 304*b* may be aligned with and coupled to lower mold portion 304*a* to close corebox 302 and form headcore cavities 306. Next, blow tubes 308 may be inserted into upper mold portion 304*b*. For example, each blow tube 308 may be positioned within a respective blow hole of upper mold portion 304*b* such that sand may fill headcore cavities 306 in a horizontal fashion.

Figure 6A:
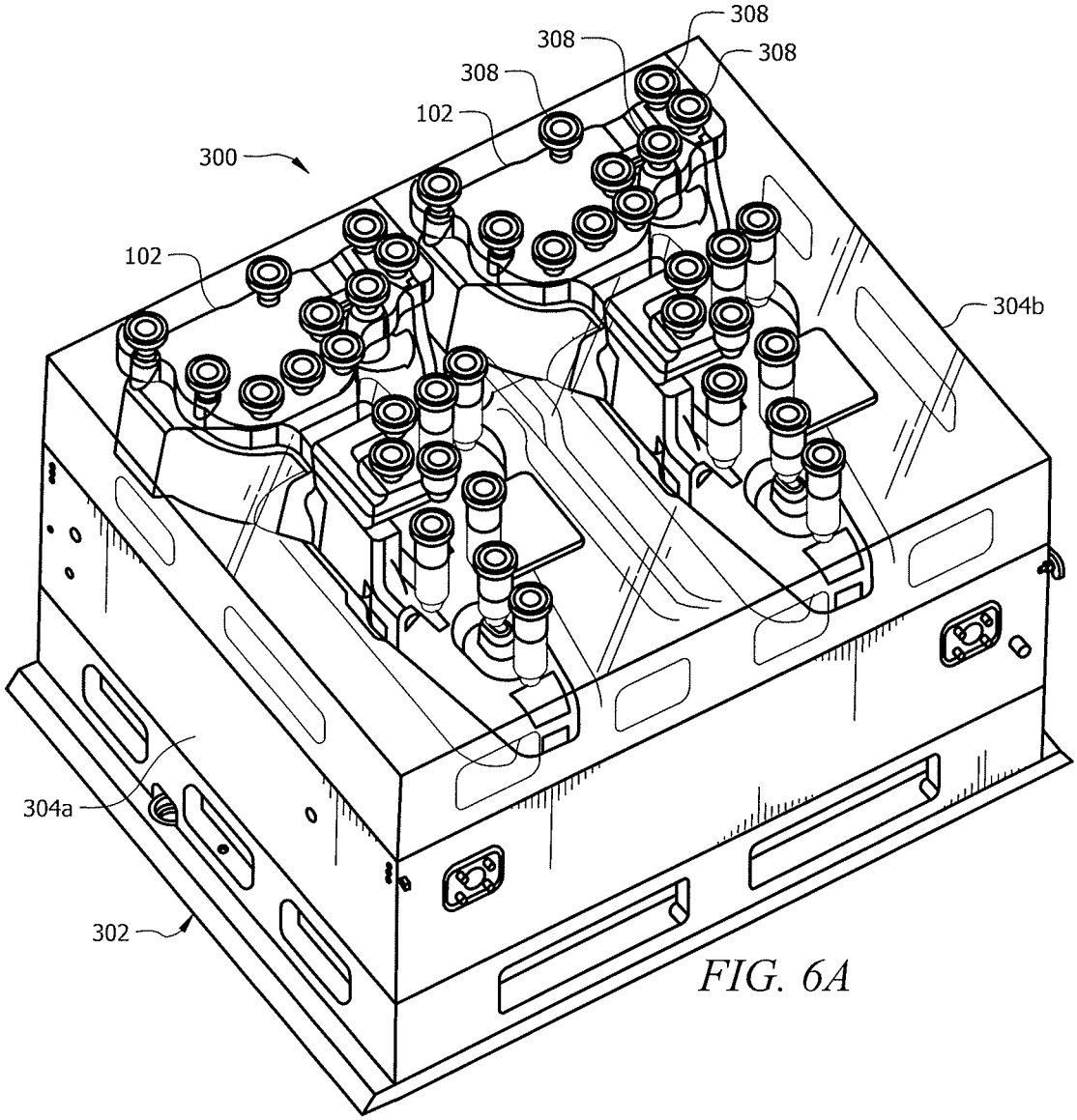
FIGS. 6A through 6C illustrate perspective views of coupler headcores manufactured in an example headcore manufacturing assembly, in accordance with particular embodiments.
Figure 6B:
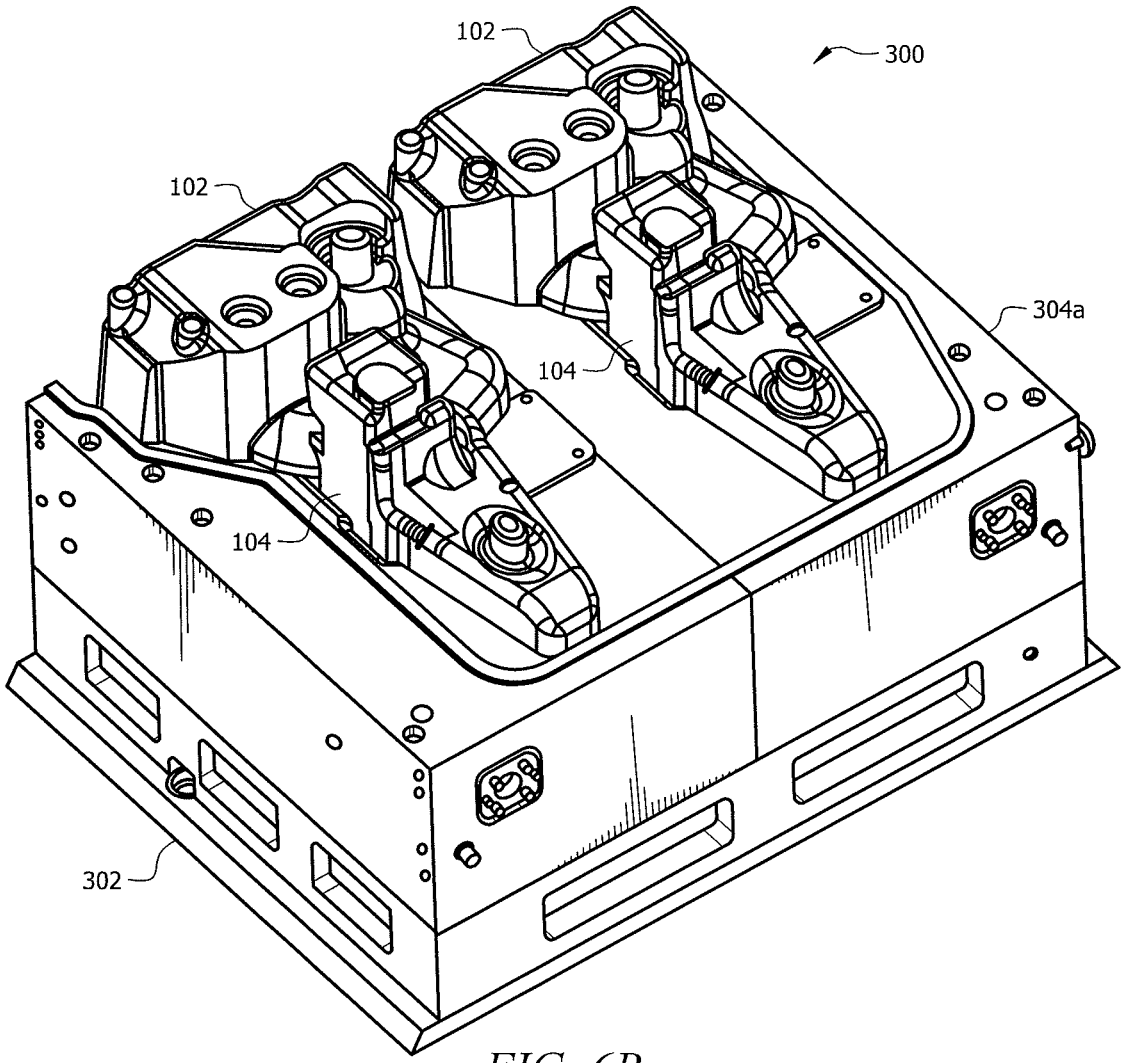
Figure 6C:
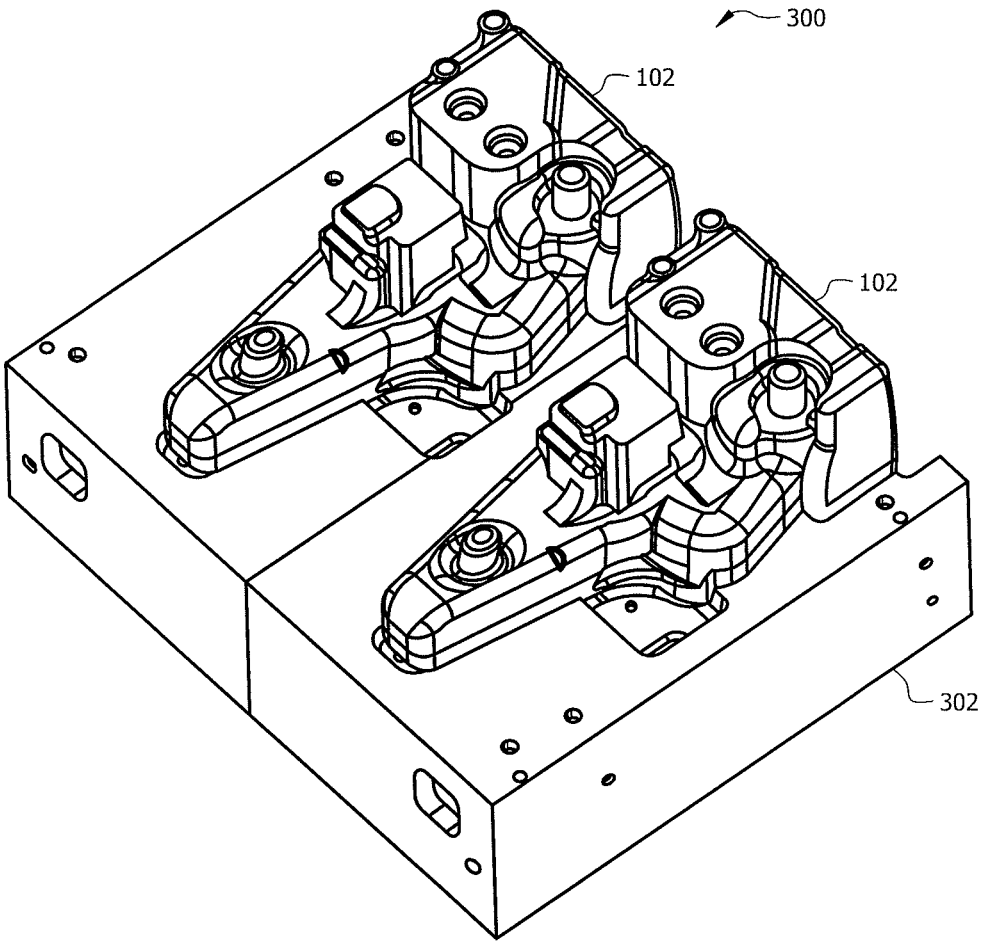

After blow tubes 308 have been positioned in the respective blow holes, headcore cavities 306 are at least partially filled, using any suitable machinery, with sand which adheres around rotor cores 104, by chemical reaction, to form headcores 102, as illustrated in FIGS. 6A through 6C. In certain embodiments, after filling headcore cavities 306 with sand, a gassing process occurs, which may involve amine gas entering the cavities to solidify the sand. Furthermore, in certain embodiments, before filling headcore cavities 306, sand may be mixed with a resin.

As a result of using rotor cores 104 to manufacture coupler headcores 102, (1) the volume of sand blown into corebox 302 is decreased; (2) the complexity of the parting lines of headcores 102 is increased because their parting lines are formed in two separate planes and are 90 degrees from one another (e.g., rotor core 104 encompassed within headcore 102 may have a vertical parting line and the resulting headcore 102 may have a horizontal parting line); (3) the manufacturability of the complex geometry of a railcar coupler head is increased because one core (e.g., headcore 102), instead of two conventional cores (e.g., a conventional headcore and a rotary lock core), may be used to form the internal surfaces and cavities of the railcar coupler head; and (4) the possibility of core shifting during the casting process and the need to use chaplets and nails to secure the cores in place within the casting box is eliminated. Moreover, using rotor core 104 to form headcore 102 reduces the total number of internal cores required to manufacture a railcar coupler (e.g., from 8 cores to 4 or 5 cores) and increases the total number of core prints (e.g., from 1 core print to 8 core prints) of headcore 102.

Although particular examples of headcores 102, rotor cores 104, headcore manufacturing assembly 300, corebox 302, upper and lower mold portions 304, headcore cavities 306, and blow tubes 308 have been described with respect to FIGS. 5A through 5C, this disclosure contemplates any suitable headcores 102, rotor cores 104, headcore manufacturing assembly 300, corebox 302, upper and lower mold portions 304, headcore cavities 306, and blow tubes 308 configured in any suitable manner. Furthermore, while particular examples of positioning components of headcore manufacturing assembly 300 have been described, the present disclosure contemplates any suitable placement of any components of headcore manufacturing assembly 300 in any suitable order and in any suitable direction.

FIGS. 6A through 6C illustrate perspective views of coupler headcores manufactured in an example headcore manufacturing assembly, in accordance with particular embodiments. As described in detail above with respect to FIGS. 5A through 5C, headcores 102 are formed from sand that adheres around rotor cores 104. Advantages of manufacturing headcores 102 using rotor cores 104 (among other things) include, but are not limited to, reducing the geometry complexity and blow-time cycle for manufacturing coupler headcores (because the process for forming headcores 102 of the present disclosure uses less sand), which in turn simplifies the headcore manufacturing process. Moreover, using rotor core 104 to form headcore 102 reduces the total number of internal cores required to manufacture a railcar coupler (e.g., from 8 cores to 4 or 5 cores) and increases the total number of core prints (e.g., from 1 core print to 8 core prints) of headcore 102.

Although FIGS. 6A through 6C illustrate each rotor core 104 as being integrated with a respective headcore 102, in certain embodiments, rotor core 104 may be separate from headcore 102 and/or any other component of FIGS. 6A through 6C.

Figure 7B:
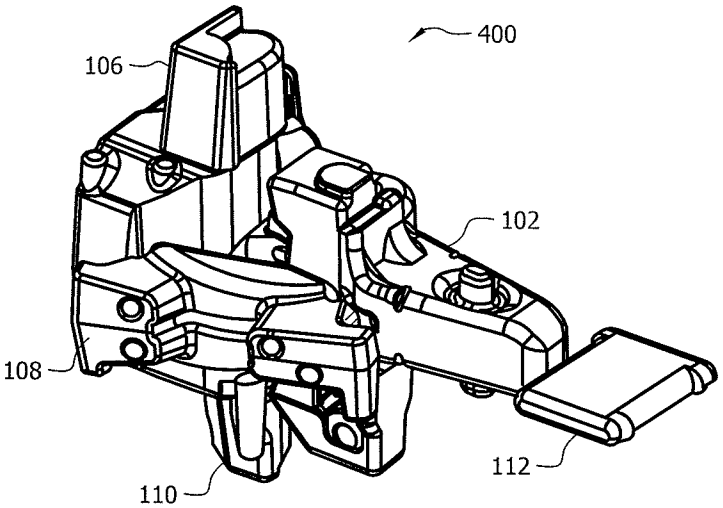
FIGS. 7A through 7B illustrate an exploded view and a perspective view of example components of a coupler manufacturing assembly, in accordance with particular embodiments.
Figure 7A:
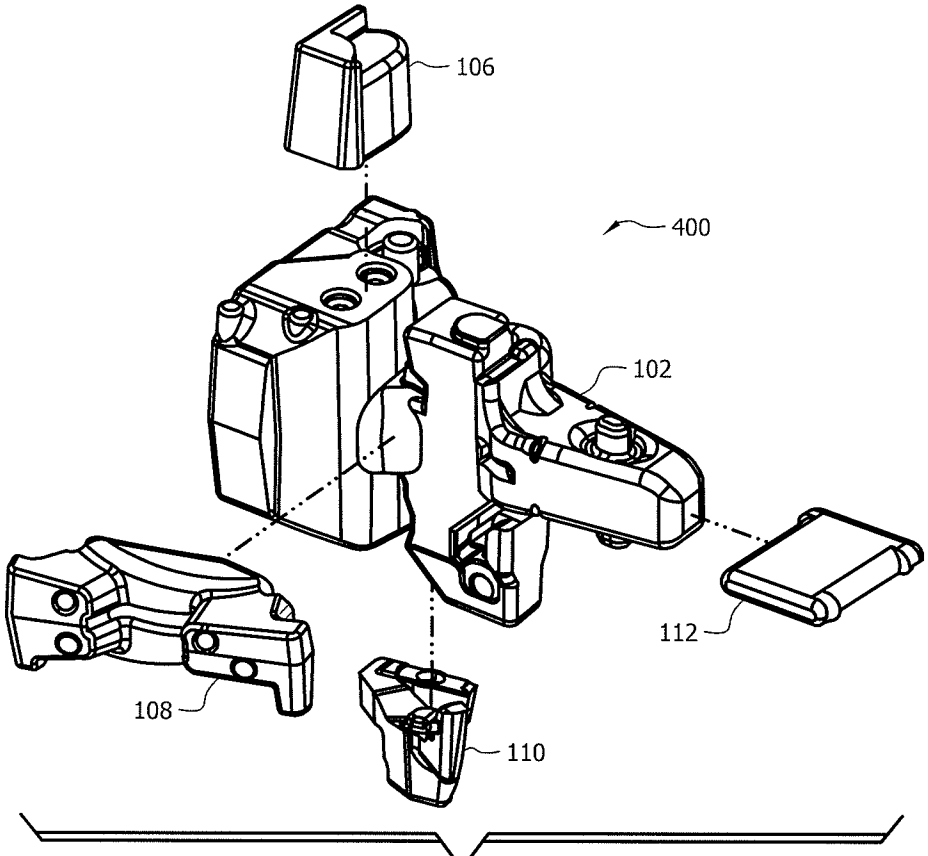

FIGS. 7A through 7B illustrate an exploded view and a perspective view of example components of a coupler manufacturing assembly, in accordance with particular embodiments. Coupler manufacturing assembly 400 may include headcore 102 comprising rotor core 104 (e.g., to form the internal cavities of a coupler head, upper and lower lock chambers, interior of the shank, the rotor trunnion, and the front face of a coupler head of a railcar coupler), upper shelf core 106 (e.g., to form the upper shelf ("hood") of a coupler head of a railcar coupler), guard-arm core 108 (e.g., to form the internal cavities of a guard arm portion of a railcar coupler), bottom shelf core 110 (e.g., to form the bottom shelf, lower portion of a C10 opening, and a brake hose lug of a railcar coupler), and key slot core 112 (e.g., to form the geometry for a key slot opening of railcar coupler). These cores generally may be used to form one or more cavities of a railcar coupler.

In certain embodiments, coupler manufacturing assembly 400 may be used to produce an SE60 coupler. Alternatively, coupler manufacturing assembly 400 may be used to produce any suitable coupler. Coupler manufacturing assembly 400 generally includes fewer cores for manufacturing railcar couplers than traditional coupler manufacturing assembles (e.g., 5 cores instead of 8 cores).

Headcore 102 comprising rotor core 104, upper shelf core 106, guard-arm core 108, bottom shelf core 110, and/or key slot core 112 may be made of sand resin and/or any other suitable material, and may each be configured to form one or more cavities of a coupler casting. In the typical manufacturing process of coupler castings, headcores 102, upper shelf cores 106, guard-arm cores 108, bottom shelf cores 110, and key slot cores 112 are placed in portions of a drag mold and/or a cope mold of a casting box prior to closing the casting box. For example, each of these components may be inserted and/or stacked within a certain portion of a drag mold and/or cope mold and/or in a certain sequence. Contrary to components of conventional coupler manufacturing assemblies, the components of manufacturing assembly 400 do not need to be secured in place within casting box 114 using nails and/or chaplets.

Although FIGS. 7A through 7B illustrate each of headcore 102, upper shelf core 106, guard-arm core 108, bottom shelf core 110, and key slot core 112 as being separate components from each of headcore 102, upper shelf core 106, guard-arm core 108, bottom shelf core 110, and key slot core 112, in certain embodiments, headcore 102, upper shelf core 106, guard-arm core 108, bottom shelf core 110, and key slot core 112 may be integrated with any components of FIGS. 7A through 7B. Furthermore, while particular examples of headcore 102, upper shelf core 106, guard-arm core 108, bottom shelf core 110, and key slot core 112 have been described, this disclosure contemplates any suitable headcore 102, upper shelf core 106, guard-arm core 108, bottom shelf core 110, and key slot core 112 configured in any suitable manner.

Figure 8B:
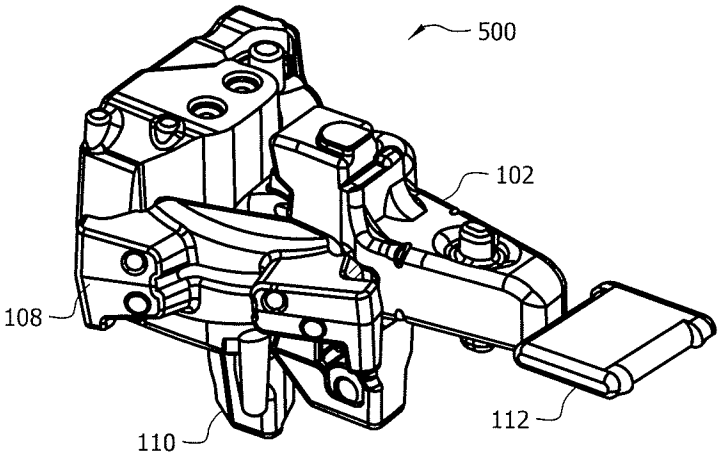
FIGS. 8A through 8B illustrate an exploded view and a perspective view of example components of another coupler manufacturing assembly, in accordance with particular embodiments.
Figure 8A:
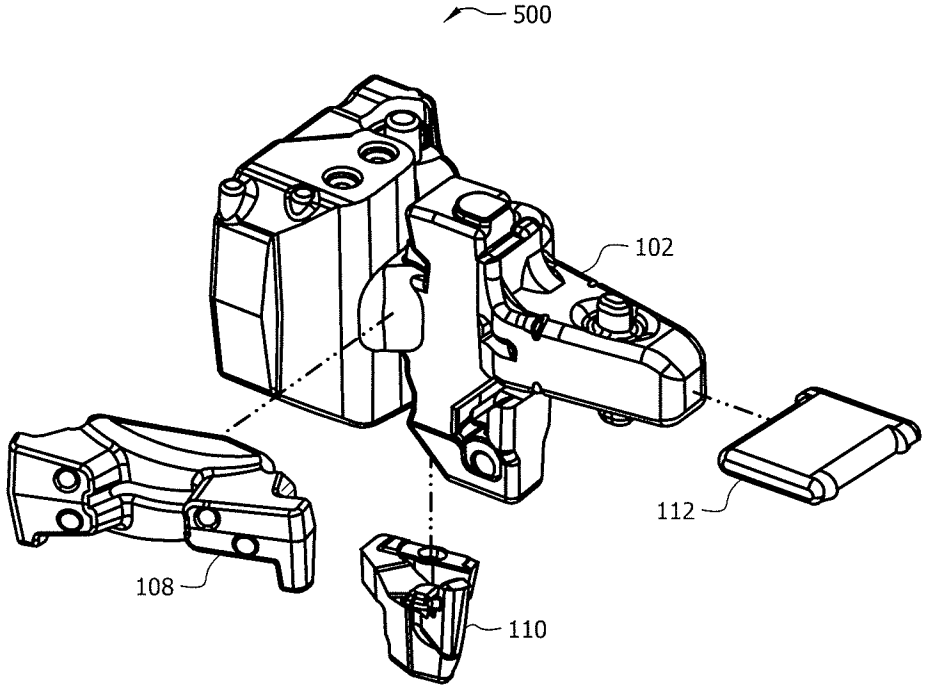

FIGS. 8A through 8B illustrate an exploded view and a perspective view of example components of another coupler manufacturing assembly, in accordance with particular embodiments. Coupler manufacturing assembly 500 may include headcore 102 comprising rotor core 104, guard-arm core 108, bottom shelf core 110, and key slot core 112. In certain embodiments, coupler manufacturing assembly 500 may be used to produce an SBE60 coupler. Alternatively, coupler manufacturing assembly 500 may be used to produce any suitable coupler. Coupler manufacturing assembly 500 generally includes fewer cores for manufacturing railcar couplers than traditional coupler manufacturing assemblies (e.g., 4 cores instead of 7 cores).

Headcore 102 comprising rotor core 104, guard-arm core 108, bottom shelf core 110, and/or key slot core 112 may be made of sand resin and/or any other suitable material, and may each be configured to form one or more cavities of a coupler casting. In the typical manufacturing process of coupler castings, headcores 102, guard-arm cores 108, bottom shelf cores 110, and key slot cores 112 are placed in portions of a drag mold and/or a cope mold of a casting box prior to closing the casting box. For example, each of these components may be inserted and/or stacked within a certain portion of a drag mold and/or a cope mold and/or in a certain sequence. Contrary to components of conventional coupler manufacturing assemblies, the components of manufacturing assembly 400 do not need to be secured in place within casting box 114 using nails and/or chaplets.

Although FIGS. 8A through 8B illustrate each of headcore 102, guard-arm core 108, bottom shelf core 110, and key slot core 112 as being separate components from each of headcore 102, guard-arm core 108, bottom shelf core 110, and key slot core 112, in certain embodiments, headcore 102, guard-arm core 108, bottom shelf core 110, and key slot core 112 may be integrated with any components of FIGS. 8A through 8B. Furthermore, while particular examples of headcore 102, guard-arm core 108, bottom shelf core 110, and key slot core 112 have been described, this disclosure contemplates any suitable headcore 102, guard-arm core 108, bottom shelf core 110, and key slot core 112 configured in any suitable manner.

Figure 9:
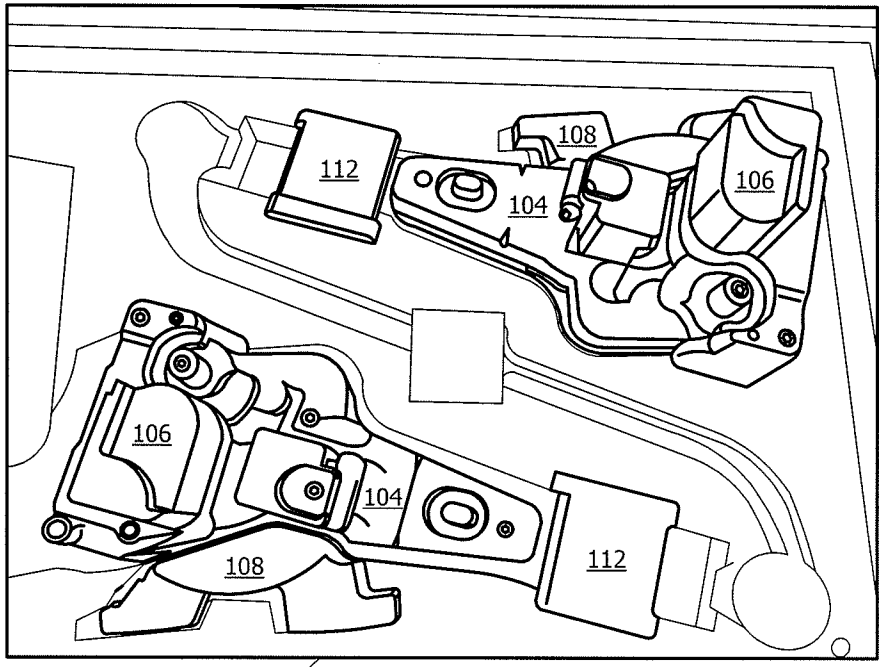
FIG. 9 illustrates a top view of example components of a coupler manufacturing assembly positioned within a casting box, in accordance with particular embodiments.
Figure 9:
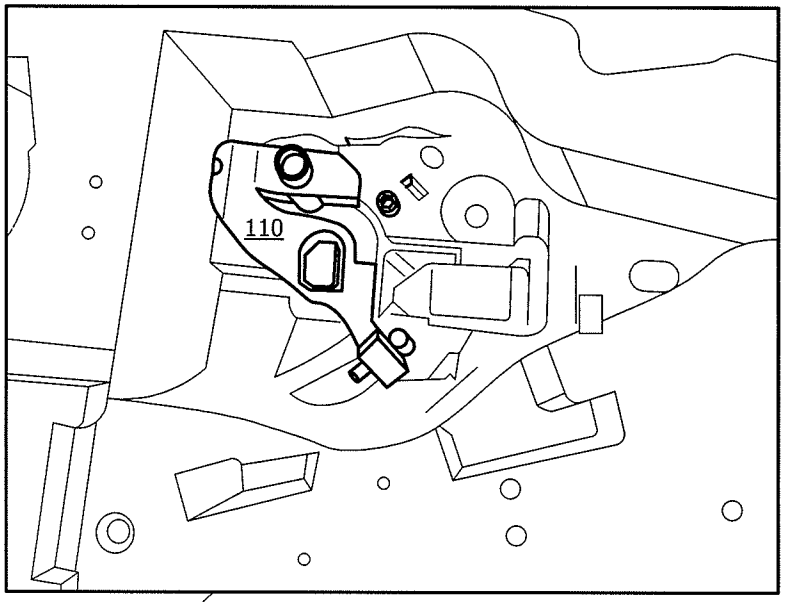

FIG. 9 illustrates a top view of example components of a coupler manufacturing assembly positioned within a casting box, in accordance with particular embodiments. Coupler manufacturing assembly 400 may include headcore 102 comprising rotor core 104, upper shelf core 106, guard-arm core 108, bottom shelf core 110, key slot core 112, and casting box 114. Coupler manufacturing assembly may also include a gating assembly, chills, and vents. In certain embodiments, coupler manufacturing assembly 400 may be used to produce an SE60 coupler. Alternatively, coupler manufacturing assembly 400 may be used to produce any suitable coupler. In general, coupler manufacturing assembly 400 includes fewer cores than conventional coupler manufacturing assemblies (e.g., 5 cores as opposed to 8 cores).

Casting box 114 may include a drag mold (shown) and a cope mold (not shown) into which a molten alloy, such as liquid steel, is poured in order to manufacture railcar couplers. Each of drag mold and cope mold may include internal walls defining at least in part perimeter boundaries of coupler mold cavities. Drag and cope molds may comprise green sand, which may include a combination of sand, water, and/or clay. Green sand may be considered green because it is not baked in certain embodiments (e.g., there is no chemical bonding and it is not heated or treated). Other embodiments may utilize other suitable materials, such as other types of sand or plaster, to make up drag and cope molds. In some embodiments, the sand casting process may include chemically bonded molds, plaster molds, no bake molds, or vacuum process molds. Although FIG. 9 illustrates casting box 114 as including only two coupler mold cavities, casting box 114 may include any number of coupler mold cavities.

Headcores 102, upper shelf cores 106, guard-arm cores 108, bottom shelf cores 110, and/or key slot cores 112 are generally used to form cavities in the coupler castings when the molten alloy solidifies around the cores. Each of these cores may comprise sand resin and/or any other suitable material. In the typical manufacturing process of coupler castings, headcores 102, upper shelf cores 106, guard-arm cores 108, bottom shelf cores 110, and key slot cores 112 are placed in portions of a drag mold and/or a cope mold of a casting box prior to closing the casting box. For example, each of these components may be inserted and/or stacked within a certain portion of a drag mold and/or a cope mold and/or in a certain sequence. Contrary to components of conventional coupler manufacturing assemblies, the components of manufacturing assembly 400 (and manufacturing assembly 500 of FIGS. 8A through 8B) do not need to be secured in place within casting box 114 using nails and/or chaplets.

In an example embodiment, at least two bottom shelf cores 110 may first be placed in an appropriate location within casting box 114. Headcores 102 may then be positioned within casting box 114 and/or coupled to bottom shelf cores 110. Once headcores 102 are positioned within casting box 114, upper shelf cores 106 may be coupled to headcores 102. Next, guard-arm cores 108 and key slot cores 112 may be positioned within casting 114 at an appropriate location. After the cores have been placed within casting box 114, casting box 114 may be closed to form coupler mold cavities.

In general, using manufacturing assembly 400 (and manufacturing assembly 500) to produce railcar couplers, instead of conventional coupler manufacturing assemblies, may increase the manufacturability of railcar couplers because fewer cores will be used to form each railcar coupler (e.g., four to five cores instead of seven to eight cores), decrease variability and reduce the possibility of internal and/or external inconsistencies in coupler castings because fewer cores will be used to form railcar couplers (thereby increasing the stability and strength of the coupler castings), and simplify the mold setting process because fewer cores will be set in coupler cavities of castings boxes and chaplets and nails will not be needed to secure those cores in place within the cavities.

In particular, a conventional coupler manufacturing assembly may include a pin core (e.g., to form the lower portion of a C-10 pinhole cavity (which generally allows access to a C10 pin, during disassembly)), a rotary lock core (e.g., to form the bottom portion of a rotor trunnion), a hose lug core (e.g., to form a brake hose lug (which may be used to support a brake hose)), a lower shelf core (e.g., to form the bottom shelf geometry), a head/shank core (e.g., to form the interior geometry of the coupler head, upper and lower lock chambers, shank, and/or a front face of a coupler), a guard arm core (e.g., to form the cavities of a guard arm), and a key slot core (e.g., to form the geometry for a key slot opening). On the other hand, with coupler manufacturing assemblies 400 and 500, the pin core, hose lug core, and rotary lock core are no longer necessary to manufacture a railcar coupler. In certain embodiments, the conventional rotary lock core may be encompassed within headcore 102 (e.g., via rotor core 104) and the conventional pin and hose lug cores may be encompassed within bottom shelf core 110.

Although FIG. 9 illustrates each of headcore 102, upper shelf core 106, guard-arm core 108, bottom shelf core 110, key slot core 112, and casting box 114 as being separate components from each of headcore 102, upper shelf core 106, guard-arm core 108, bottom shelf core 110, key slot core 112, and casting box 114, in certain embodiments, headcore 102, upper shelf core 106, guard-arm core 108, bottom shelf core 110, key slot core 112, and casting box 114 may be integrated with any components of FIG. 9. Furthermore, while particular examples of positioning headcore 102, upper shelf core 106, guard-arm core 108, bottom shelf core 110, and key slot core 112 have been described, this disclosure contemplates any suitable placement of headcore 102, upper shelf core 106, guard-arm core 108, bottom shelf core 110, and key slot core 112 in any suitable order.

Figure 10:
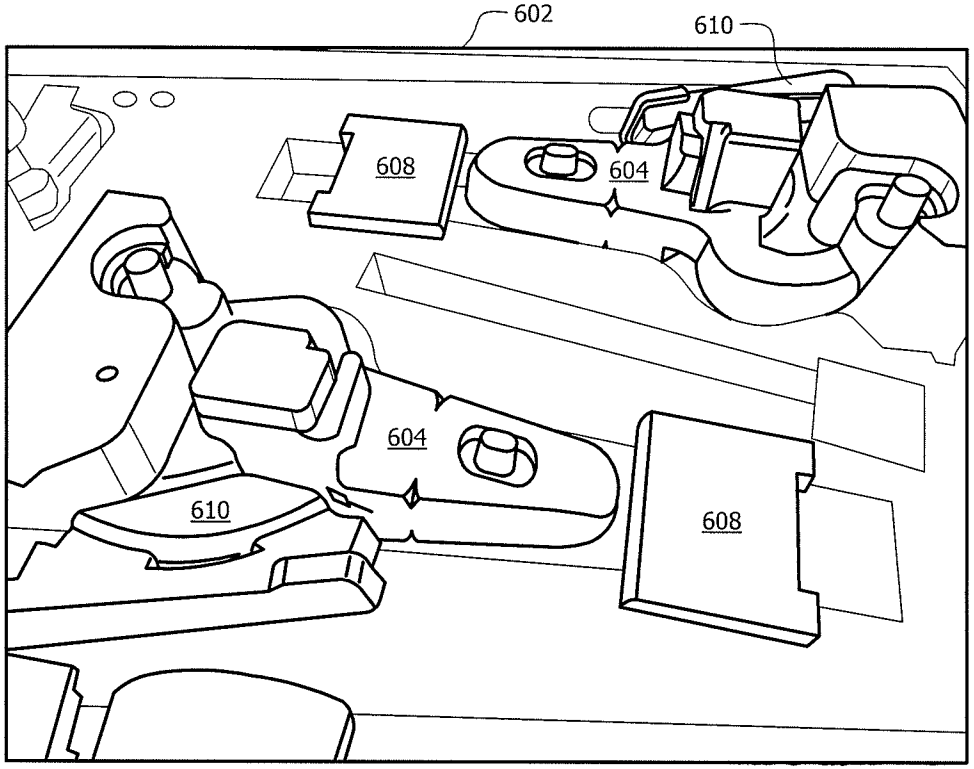
FIG. 10 illustrates a perspective view of example components of a conventional coupler manufacturing assembly positioned within a casting mold.
Figure 10:
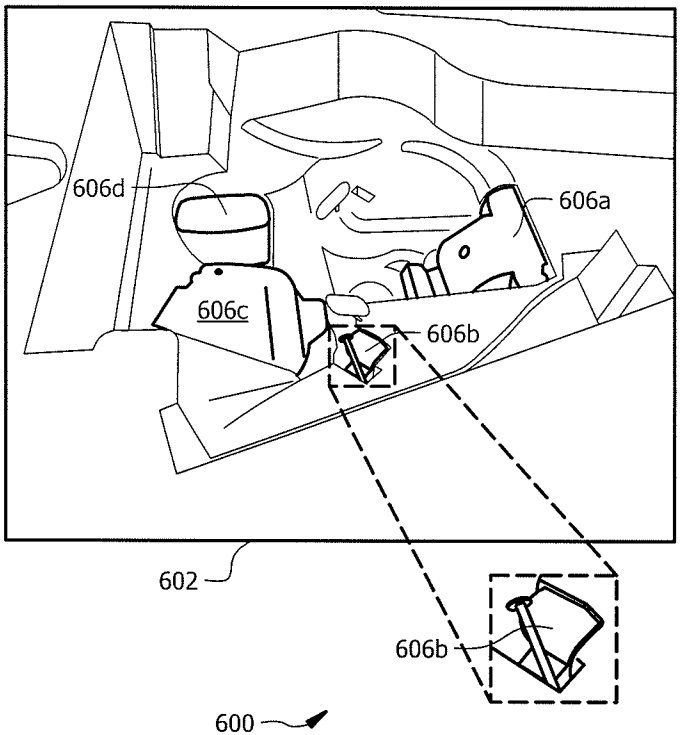

FIG. 10 illustrates a perspective view of example components of a conventional coupler manufacturing assembly positioned within a casting mold. Conventional coupler manufacturing assembly 600 includes at least eight cores configured to form one or more cavities of a coupler casting and that are made from sand resin and/or any other suitable material. For example, conventional coupler manufacturing assembly 600 may include a casting mold 602, a conventional headcore 604 (e.g., a SBE60 head/shank core), a rotary lock core 606*a* (e.g., an E rotary lock core), a hose lug core 606*b* (e.g., an E hose lug core), a lower shelf core 606*c* (e.g., an E lower shelf core), a pin core 606*d* (e.g., an SBE pin core), a key slot core 608 (e.g., an E60 key slot core), a guard-arm core 610 (e.g., an E guard arm core), and an upper shelf core (not shown). In such an example, headcore 604 may be used to form the interior geometry of the coupler head, upper and lower lock chambers, shank, and/or a front face of a coupler; rotary lock core 606*a* may be used to form the bottom portion of a rotor trunnion; hose lug core 606*b* may be used to form a brake hose lug (which may be used to support a brake hose); lower shelf core 606*c* may be used to form the bottom shelf geometry; pin core 606*d* may be used to form the lower portion of a C-10 pinhole cavity (which generally allows access to a C10 pin, during disassembly); key slot core 608 may be used to form the geometry for a key slot opening; and guard arm core 610 may be used to form the cavities of a guard arm of a railcar coupler. In certain embodiments, conventional coupler manufacturing assembly 600 may be used to produce an SE60 coupler. Alternatively, conventional coupler manufacturing assembly 600 may be used to produce any suitable coupler.

Casting mold 602 of FIG. 10 may be similar to casting box 114 of FIG. 9. For example, casting mold 602 may include a drag mold (shown) and a cope mold (not shown) into which a molten alloy, such as liquid steel, is poured in order to manufacture cast railcar couplers. Each of drag mold and cope mold may include internal walls defining at least in part perimeter boundaries of coupler mold cavities. Drag and cope molds may comprise green sand, which may include a combination of sand, water, and/or clay. Green sand may be considered green because it is not baked in certain embodiments (e.g., there is no chemical bonding and it is not heated or treated). Other embodiments may utilize other suitable materials, such as other types of sand or plaster, to make up drag and cope molds. In some embodiments, the sand casting process may include chemically bonded molds, plaster molds, no bake molds, or vacuum process molds.

In a conventional manufacturing process of coupler castings, conventional headcore 604, rotary lock core 606*a*, hose lug core 606*b*, lower shelf core 606*c*, pin core 606*d*, key slot core 608, guard-arm core 610, and the upper shelf core (not shown) are placed in portions of a drag mold and/or a cope mold of casting mold 602 prior to closing casting mold 602. For example, each of these components may be inserted and/or stacked within a certain portion of a drag mold and/or a cope mold of casting mold 602 and/or in a certain sequence. In this existing manufacturing process (unlike the coupler manufacturing process of the present disclosure), conventional headcores 604, rotary lock cores 606*a*, hose lug cores 606*b*, lower shelf cores 606*c*, pin cores 606*d*, key slot cores 608, guard-arm cores 610, and upper shelf cores (not shown) typically are secured in place within casting mold 602 using nails and/or chaplets. Further, as can be seen from FIG. 10, the conventional coupler manufacturing process uses 7 to 8 internal cores to manufacture each coupler, as compared to the coupler manufacturing process of the present disclosure, which uses 4 to 5 internal cores to manufacture each coupler.

Figure 11A:
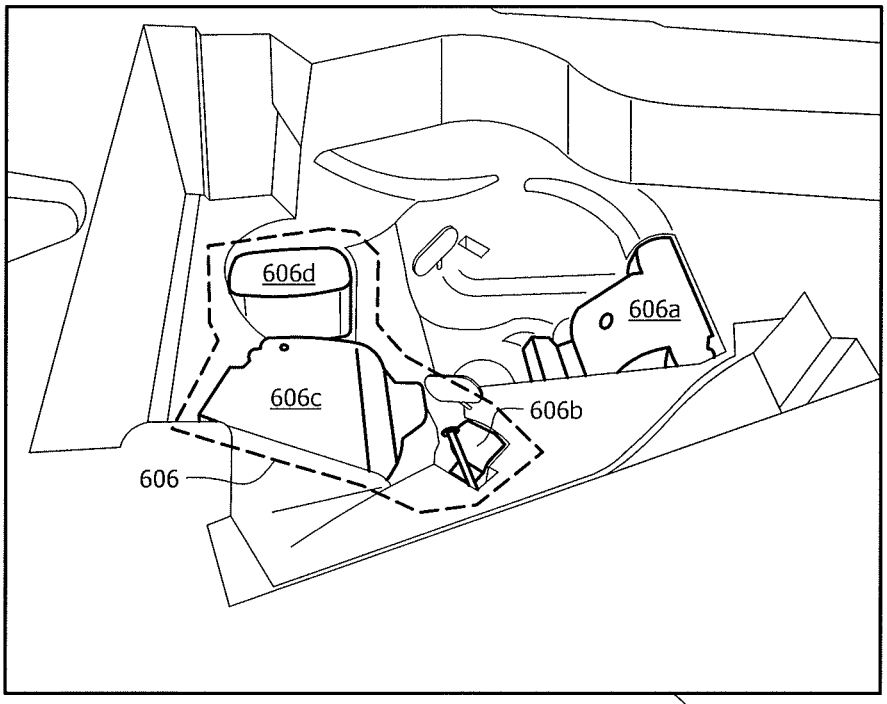
FIG. 11A illustrates a partial view of a conventional coupler manufacturing assembly of FIG. 10.

FIG. 11A illustrates a partial view of conventional coupler manufacturing assembly 600 of FIG. 10.

Figure 11B:
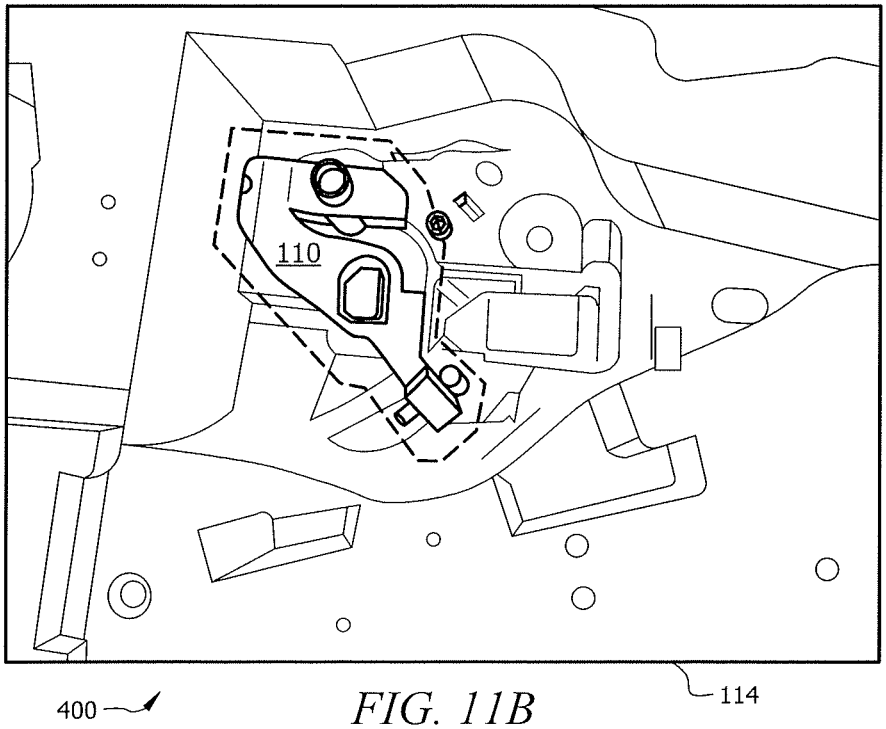
FIG. 11B illustrates a partial view of example coupler manufacturing assemblies of FIGS. 7A through 9, in accordance with particular embodiments.

FIG. 11B illustrates a partial view of coupler manufacturing assemblies 400 and 500 of FIGS. 7A through 9, in accordance with particular embodiments. As illustrated, hose lug core 606*b*, lower shelf core 606*c*, and pin core 606*d* of conventional coupler manufacturing assembly 600 may be encompassed within bottom shelf core 110 of manufacturing assemblies 400 and 500.

Figure 12:
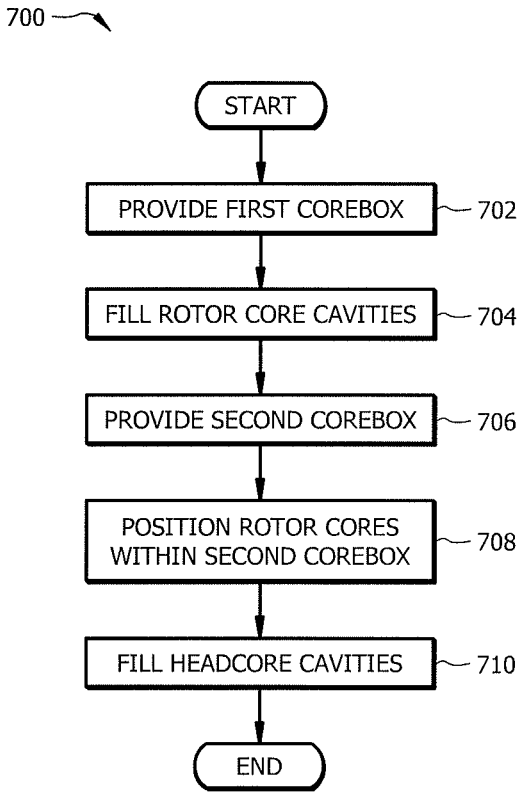
FIG. 12 illustrates an example of a method for manufacturing railcar coupler headcores, in accordance with particular embodiments.

FIG. 12 illustrates an example of a method for manufacturing railcar coupler headcores, in accordance with particular embodiments. In general, a method 700 facilitates producing one or more coupler headcores, such as headcores 102. In certain embodiments, one or more steps of method 700 may refer to components of FIGS. 1 through 9 and may be performed by a foundryman and/or any suitable machinery.

The method begins at step 702 where a first corebox, such as corebox 200 of FIGS. 3A through 3B, is provided. Corebox 200 may include internal walls defining at least in part perimeter boundaries of a plurality of rotor core cavities. Corebox 200 may refer to a coldbox or any other suitable corebox. Corebox 200 may also include an upper mold portion and a lower mold portion. In certain embodiments, corebox 200 may include vent slots and/or blow tubes (such as blow tubes 308 of FIGS. 5A through 6A).

At step 704, rotor core cavities may be at least partially filled, using any suitable machinery, with a sand resin (and/or any other suitable material) which sets to form rotor cores, such as rotor cores 104 of FIGS. 3A through 3B. In certain embodiments, three rotor cores 104 may be manufactured in corebox 200 at one time. Alternatively, any suitable number of rotor cores 104 may be manufactured in corebox 200 at one time (such as one rotor core 104, two rotor cores 104, four rotor cores 104, ten rotor cores 104, and so on). After these cavities are filled with a sand resin, the sand resin eventually sets to form rotor cores 104 having one or more features described above with respect to FIGS. 1 through 9. Rotor cores 104 may then be removed from corebox 200 and used in the next step of method 700.

A second corebox, such as corebox 302 of FIGS. 4 through 6C, may be provided at step 706. Corebox 302 of headcore manufacturing assembly 300 may have internal walls defining at least in part perimeter boundaries of at least two headcore cavities, such as headcore cavities 306 of FIGS. 4 through 6C. In general, corebox 302 is used to manufacture one or more headcores, such as one or more headcores 102 of FIGS. 1A through 1C. Corebox 302 may be made of iron, steel, aluminum, plastic, wood, and/or any other suitable material. An example corebox 302 may be a coldbox, hotbox, warmbox, and/or any other suitable corebox.

At step 708, at least two rotor cores 104 may be placed in an appropriate location within a portion of corebox 302, such as a lower mold portion 304*a* or an upper mold portion 304*b* of FIGS. 5A through 6C. For example, a first rotor core 104 may be positioned vertically within a lower portion of a headcore cavity 306*a* of lower mold portion 304*a* of corebox 302 and a second rotor core 104 may be positioned vertically within a lower portion of a headcore cavity 306*b* of lower mold portion 304*a* of corebox 302. In certain embodiments, rotor cores 104 may be secured to a respective headcore cavity 306.

Once rotor cores 104 have been placed within lower mold portion 304*a* of corebox 302, upper mold portion 304*b* of corebox 302 may be aligned with and coupled to lower mold portion 304*a* to close corebox 302 and form headcore cavities 306. In certain embodiments, blow tubes, such as blow tubes 308 of FIGS. 5A through 6A, may then be mounted to upper mold portion 304*b*. For example, each blow tube 308 may be positioned within a respective blow hole of upper mold portion 304*b* such that sand may fill headcore cavities 306 in a horizontal fashion.

After blow tubes 308 have been positioned in the respective blow holes, at step 710, headcore cavities 306 are at least partially filled, using any suitable machinery, with a sand resin which adheres around rotor cores 104, by chemical reaction, to form at least a first headcore 102 and a second headcore 102, as illustrated in FIGS. 6A through 6C. In certain embodiments, the sand resin is blown into each headcore cavity 306, via blow tubes 308, at nineteen different places per cavity and horizontally fills headcore cavities 306.

After these cavities are filled with a sand resin, the sand resin eventually sets to form headcores 102 having one or more features described above with respect to FIGS. 1 through 9. In certain embodiments, the resulting headcores and other internal cores may be used to manufacture coupler castings.

Once the method at least partially fills headcore cavities 306 at step 710, the method may end.

Although FIG. 12 illustrates method 700 as manufacturing two head cores 102, it should be understood that the present disclosure contemplates method 300 manufacturing any suitable number of head cores 102 (such as one head core 102, three head cores 102, ten head cores 102, and so on) in any suitable manner.

Some of the steps illustrated in FIG. 12 may be combined, modified, and/or deleted where appropriate, and additional steps may also be added to the flowchart. Additionally, steps may be performed in any suitable order without departing from the scope of the disclosure.

Advantages of headcores 102, rotor cores 104, and coupler manufacturing assemblies 100 (of FIG. 1), 400 (of FIGS. 7A though 7B and 9), and 500 (of FIGS. 8A through 8B) include, but are not limited to, (1) reducing the geometry complexity and blow-time cycle for manufacturing coupler headcores, which in turn simplifies the headcore manufacturing process; (2) increasing the manufacturability of railcar couplers by setting less cores in coupler mold cavities (e.g., setting four to five cores instead of eight cores); (3) decreasing variability and reducing the possibility of internal and/or external inconsistencies in coupler castings by setting less cores (and thereby increasing the stability and strength of the coupler castings); and (4) a novel headcore design with larger and more precise core prints, which allows for easy mold setting, tighter fit tolerance to eliminate the possibility for core shifting during pour, and eliminates the need to use chaplets and nails to secure the cores in place.

Teachings of the present disclosure may be satisfactorily used to manufacture railcar coupler headcores and railcar couplers. Modifications, additions, or omissions may be made to the systems described herein without departing from the scope of the present disclosure. The components may be integrated or separated. As used in this document, "each" refers to each member of a set or each member of a subset of a set.

Modifications, additions, or omissions may be made to the methods described herein without departing from the scope of the present disclosure. For example, the steps may be combined, modified, and/or deleted where appropriate, and additional steps may be added. Additionally, the steps may be performed in any suitable order without departing from the scope of the present disclosure.

Although particular embodiments and advantages have been described herein, it should be understood that various changes, variations, substitutions, transformations, modifications, and alterations may be suggested to one skilled in the art, and it is intended that the present disclosure encompass such changes, variations, substitutions, transformations, modifications, and alterations as fall within the spirit and scope of the appended claims.

What is claimed is:

1. A method for manufacturing a railcar coupler, comprising:

providing a first corebox having internal walls defining at least in part perimeter boundaries of at least one rotor core cavity;

at least partially filling the at least one rotor core cavity with a first sand resin, the first sand resin setting after filling to form at least one rotor core;

providing a second corebox, wherein the second corebox comprises an upper mold portion and a lower mold portion having internal walls defining at least in part perimeter boundaries of at least one headcore cavity;

placing the at least one rotor core in the lower mold portion of within the second corebox;

coupling the upper mold portion to the lower mold portion to close the second corebox wherein at least part of the at least one rotor core is not enclosed within the second corebox; and at least partially filling the at least one headcore cavity with a second sand resin, the second sand resin setting after filling to form at least one headcore, wherein a portion of the at least one headcore encompassing the at least one rotor core has a first parting line which is different from a second parting line of a second portion of the at least one headcore.

2. The method of claim 1, wherein placing the at least one rotor core within the second corebox comprises positioning the at least one rotor core within a lower portion of the at least one headcore cavity of the second corebox.

3. The method of claim 1, wherein the second corebox comprises:

the lower mold portion having internal walls defining at least in part perimeter boundaries of a lower portion of the at least one headcore cavity; and the upper mold portion having internal walls defining at least in part perimeter boundaries of an upper portion of the at least one headcore cavity.

4. The method of claim 3, further comprising coupling the upper mold portion of the second corebox to the lower mold portion of the second corebox after positioning the at least one rotor core within the second corebox.

5. The method of claim 1, further comprising inserting a plurality of blow tubes into at least a portion of the second corebox before at least partially filling the at least one headcore cavity with the second sand resin.

6. The method of claim 5, wherein at least partially filling the at least one headcore cavity with the second sand resin comprises at least partially filling the at least one headcore cavity with the second sand resin via the plurality of blow tubes.

7. The method of claim 1, wherein the at least one headcore comprises the at least one rotor core.

8. The method of claim 1, wherein the at least one headcore comprises a plurality of core prints each configured to abut a portion of a coupler cavity of a casting box.

9. The method of claim 1, further comprising:

providing a casting box having internal walls defining at least in part perimeter boundaries of at least one coupler cavity;

positioning the at least one headcore within the casting box, the at least one headcore configured to form at least one cavity of a coupler;

positioning at least one guard-arm core within the casting box, the at least one guard-arm core configured to form at least one cavity of the coupler;

positioning at least one bottom shelf core within the casting box, the at least one bottom shelf core configured to form at least one cavity of the coupler;

positioning at least one key slot core within the casting box, the at least one key slot core configured to form at least one cavity of the coupler; and at least partially filling the at least one coupler cavity with a molten alloy, the molten alloy solidifying after filling to form a coupler casting.

10. The method of claim 9, wherein the bottom shelf core comprises a pin core and a hose lug core.

* * * * *